US008651914B2

(12) United States Patent
Sisamos

(10) Patent No.: US 8,651,914 B2
(45) Date of Patent: Feb. 18, 2014

(54) SNAP-LOCK CONSTRUCTION TOY

(76) Inventor: Costas Sisamos, Limassol (CY)

( * ) Notice: Subject to any disclaimer, the term of this patent is extended or adjusted under 35 U.S.C. 154(b) by 2270 days.

(21) Appl. No.: 11/307,229

(22) Filed: Jan. 27, 2006

(65) Prior Publication Data

US 2007/0264901 A1 Nov. 15, 2007

(51) Int. Cl.
*A63H 33/04* (2006.01)
*A63H 33/06* (2006.01)
*A63H 33/08* (2006.01)

(52) U.S. Cl.
USPC ..... 446/120; 446/125; 446/85

(58) Field of Classification Search
USPC ..... 446/85, 120, 121, 122, 124, 125, 126
See application file for complete search history.

(56) References Cited

U.S. PATENT DOCUMENTS

| | | | | | |
|---|---|---|---|---|---|
| 2,609,638 | A | * | 9/1952 | Lindenmeyer | 446/126 |
| 2,885,822 | A | * | 5/1959 | Onanian | 446/121 |
| 4,012,155 | A | * | 3/1977 | Morris | 403/290 |
| 4,044,497 | A | * | 8/1977 | Bettens | 446/96 |
| 4,170,082 | A | | 10/1979 | Freedman | |
| 4,274,222 | A | | 6/1981 | Zahn | |
| 4,614,502 | A | * | 9/1986 | Nelson | 446/119 |
| 4,637,805 | A | | 1/1987 | Sweetin | |
| 5,061,219 | A | | 10/1991 | Glickman | |
| 5,137,486 | A | | 8/1992 | Glickman | |
| 5,199,919 | A | | 4/1993 | Glickman | |
| 5,346,420 | A | | 9/1994 | Glickman | |
| 5,350,331 | A | * | 9/1994 | Glickman | 446/126 |
| 5,368,514 | A | | 11/1994 | Glickman | |
| 5,421,762 | A | | 6/1995 | Glickman | |
| 5,423,707 | A | | 6/1995 | Glickman | |
| 5,427,559 | A | | 6/1995 | Glickman | |
| 5,645,463 | A | * | 7/1997 | Olsen | 446/104 |
| 5,704,186 | A | * | 1/1998 | Alcalay et al. | 52/848 |
| 5,823,843 | A | * | 10/1998 | Pohlman | 446/120 |
| 5,913,706 | A | | 6/1999 | Glickman | |
| 6,089,941 | A | | 7/2000 | Glickman | |
| 6,345,946 | B1 | * | 2/2002 | Mainini et al. | 411/508 |
| 6,843,700 | B2 | * | 1/2005 | Glickman | 446/127 |
| 7,044,825 | B2 | * | 5/2006 | Glickman et al. | 446/121 |
| 2005/0159076 | A1 | * | 7/2005 | Kowalski et al. | 446/137 |

* cited by examiner

*Primary Examiner* — Gene Kim
*Assistant Examiner* — Alyssa Hylinski
(74) *Attorney, Agent, or Firm* — Eschweiler & Associates, LLC

(57) ABSTRACT

A construction toy is disclosed which includes a set of construction components. The construction toy includes components that may be assembled by connecting male and female snap-lock connectors. A female snap-lock connector is disclosed that includes a deflectable channel opening into a wider cavity. A male snap-lock connector is disclosed with a cylindrical head, a neck, and seat. The construction components are connected by pressing a male head through a female deflectable channel and into the wider cavity allowing the deflectable channel to return to its non-deflected position surrounding the male connector neck and secure the construction component in position.

29 Claims, 23 Drawing Sheets

FIG.15A
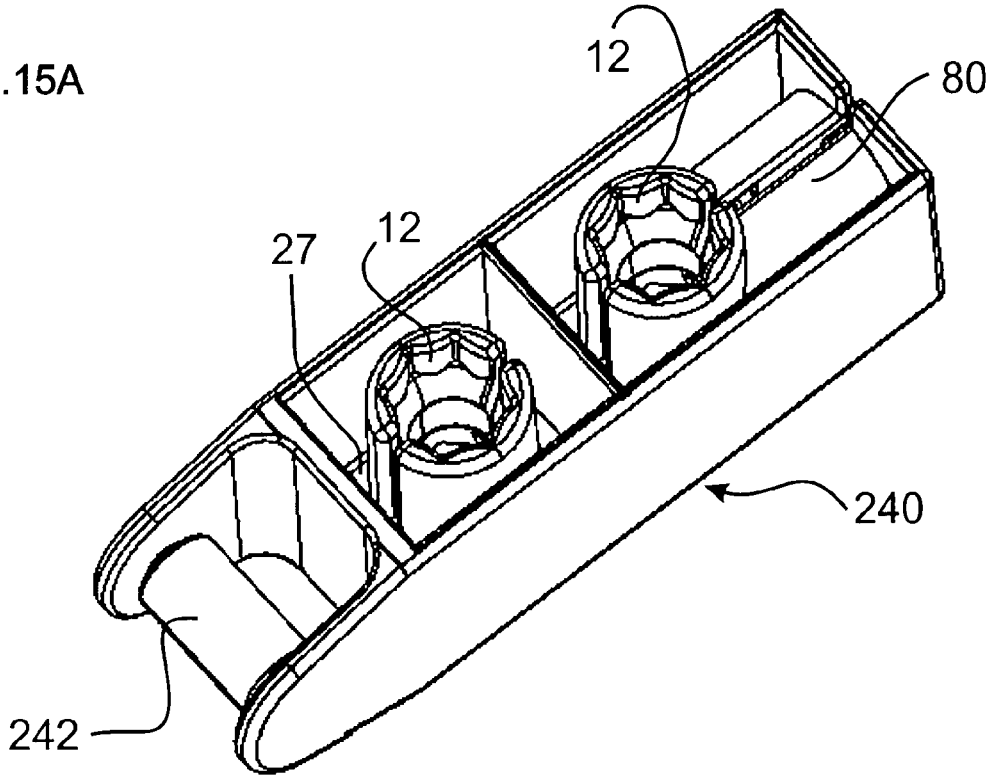
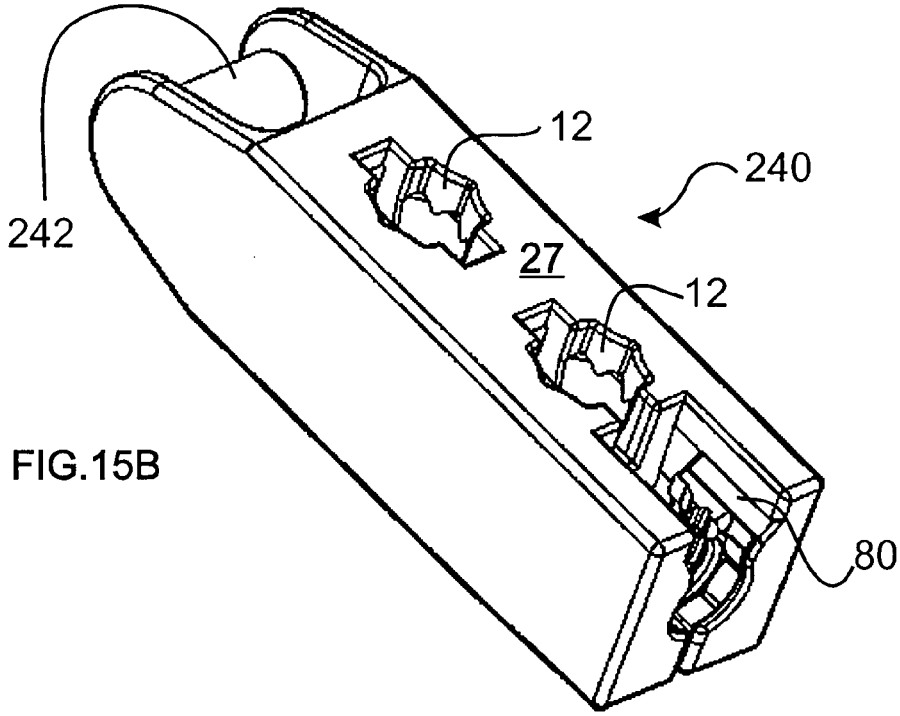
FIG.15B

FIG.16A
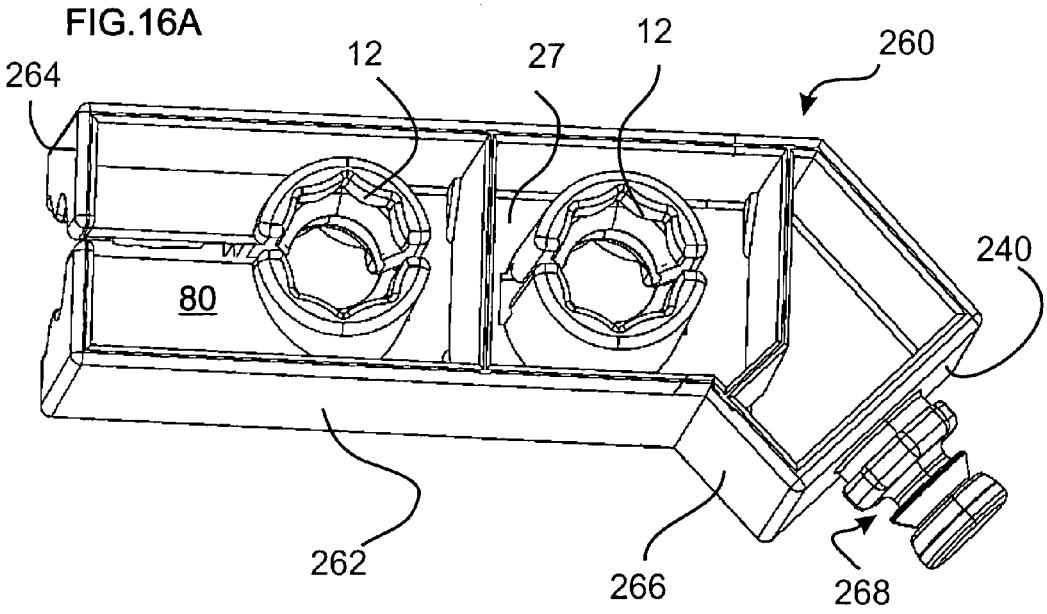
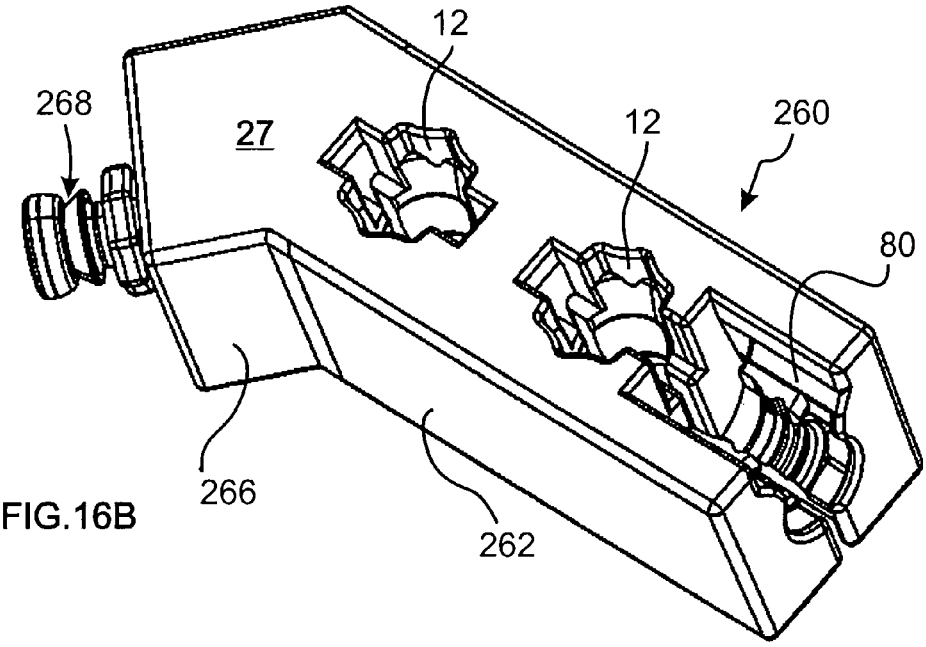
FIG.16B

FIG.17A
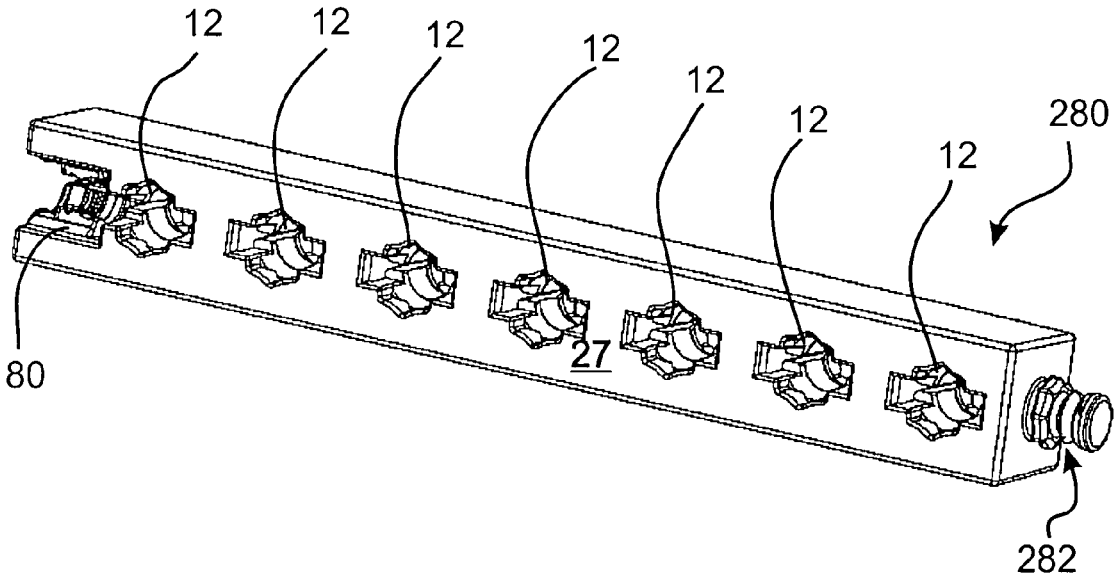
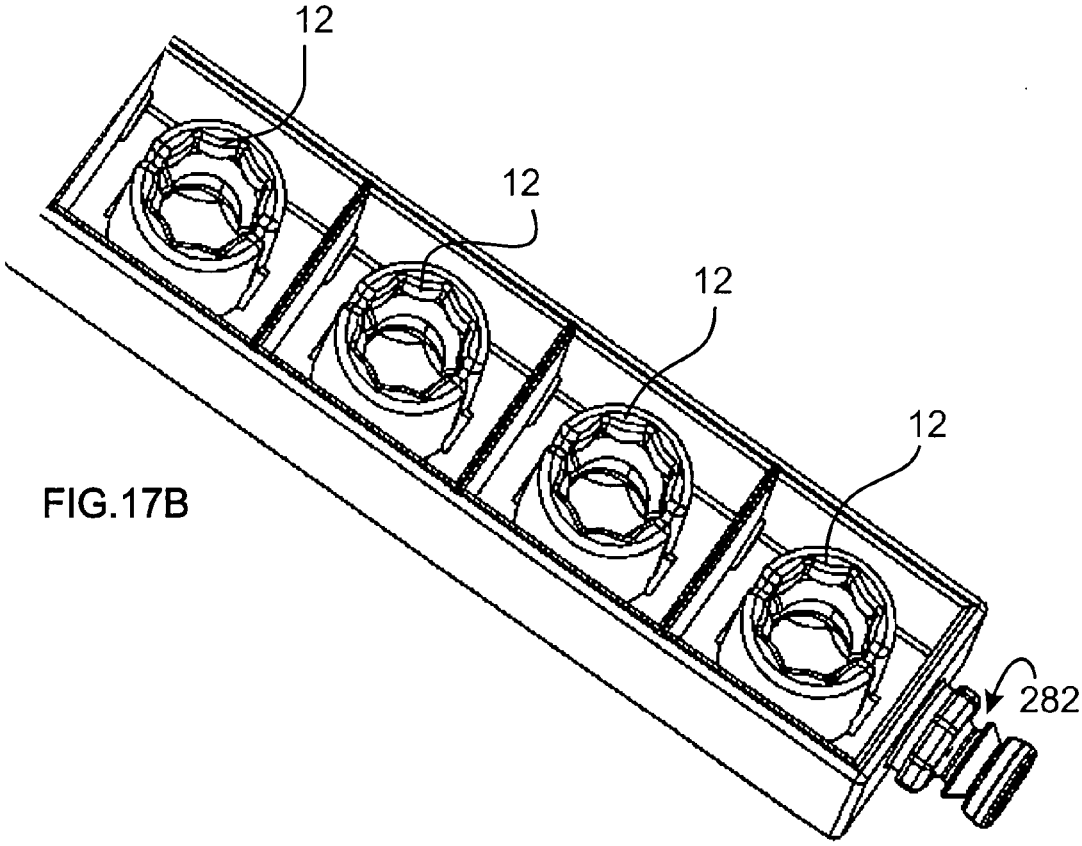
FIG.17B

SNAP-LOCK CONSTRUCTION TOY

FIELD OF THE INVENTION

The present invention relates generally to construction sets, and more particularly to construction toys with multiple shaped components removably connectable with male and female connectors.

BACKGROUND OF THE INVENTION

Construction toys have been developed over the years for play, education, and industry modeling. Among the various examples are erector and leggo construction toys.

In the case of erector sets, bolts and screws are used to assemble components. Erector components are generally planar and require construction to build three dimensional components.

In the case of leggos, components are connected by pressing together male and female portions. Components are three dimensional, however they are limited in the angular orientation of connecting components. Also, the male and female connector portions generally are smooth and held together with friction, resulting in reduced stability and ultimately abrasive wear on components.

Various others have attempted to overcome some of the limitations of such designs with various levels of success. There continues to be a need for multi-functional construction toys with multi-faceted and multi-angular connectable components. There also continues to be a need for reusable connector portions that lock into position and provide greater stability while being simple to use.

SUMMARY OF THE INVENTION

In accordance with the present invention, a multi-functional construction toy includes inter-connectable reusable snap-lock components that are multi-faceted and multi-angular enabling a user to construct assemblies of various shapes.

BRIEF DESCRIPTION OF THE DRAWINGS

The accompanying drawings incorporated in and forming a part of the specification, illustrates several aspects of the present invention, and together with the detailed description in which substantially identical elements, components, or families are commonly number, serve to explain the principles of the invention. In the drawing:

FIG. 15A shows an overhead upward view of an embodiment of a swing-rod component in accordance with the present invention.

FIG. 15B shows an overhead rear view of an embodiment of a swing-rod component in accordance with the present invention.

FIG. 16A shows an overhead upward view of an embodiment of an angle-rod component in accordance with the present invention.

FIG. 16B shows an overhead rear view of an embodiment of an angle-rod component in accordance with the present invention.

FIG. 17A shows a side rear view of an embodiment of a large M-F rod component in accordance with the present invention.

FIG. 17B shows an overhead upward view of an embodiment of a large M-F rod component in accordance with the present invention.

DETAILED DESCRIPTION OF THE INVENTION

Figure 1:
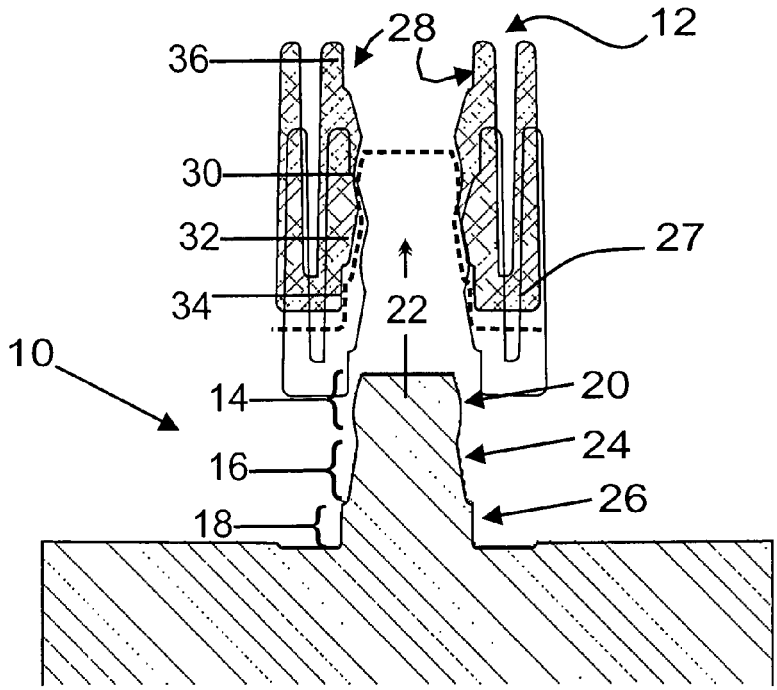
FIG. 1 shows a side view of an embodiment of a male snap-lock connector and female bi-directional snap-lock connector in accordance with the present invention.

Referring to FIG. 1, an embodiment of male snap-lock connector 10 and female bidirectional snap-lock connector 12 is shown in accordance with the present invention. Connectors 10, 12 are implemented as a part or portion of construction components. Connectors 10, 12 enable detachable snap-lock connection of various components some of which are described more fully hereinafter as components of a construction toy in accordance with the present invention.

Figure 2:
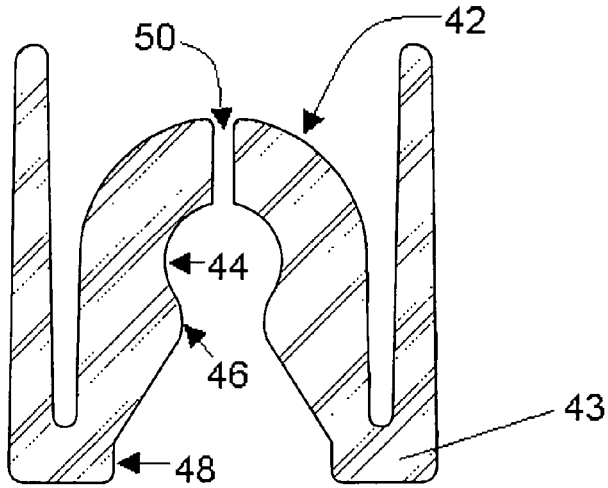
FIG. 2 shows a side view of an embodiment of a female snap-lock connector with a spherical cavity in accordance with the present invention.
Figure 3:
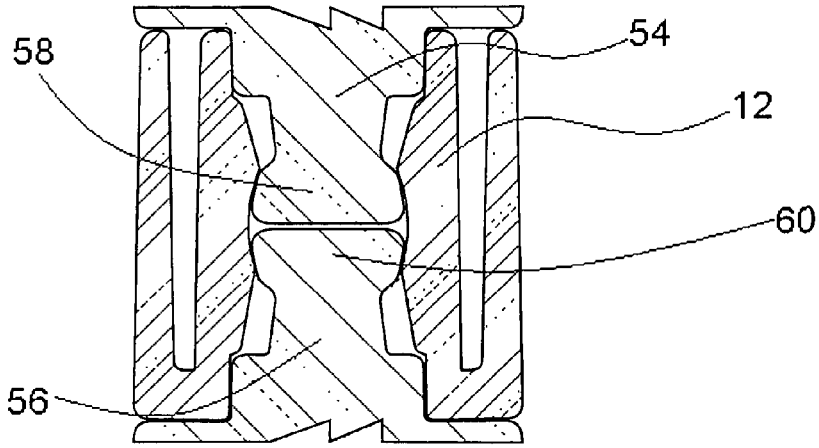
FIG. 3 shows a side view of an embodiment of two male snap-lock connectors and a female bi-directional snap-lock connector in accordance with the present invention.

Male snap-lock connector 10 is formed with a rigid plastic and shaped with head 14, neck 16, and shoulders 18. In one embodiment head 14, neck 16, and shoulder 18 are circular-shaped around a central axis extending longitudinally. In the embodiment shown in FIG. 1, head 14 extends from neck 16 and has a widened central diameter region 20 and narrowed tip 22. In another embodiment (as seen in FIG. 3), head 14 has a mushroom shaped tip 22. In yet another embodiment (as may be deduced from FIG. 2), head 14 has a spherical shape. In the embodiment shown in FIG. 1, neck 16 has a conical shape with narrow region 24 joining with the base of head 14 and a wider region 26 joining with shoulder 18. In another embodiment as shown in FIG. 2, neck 16 narrows where it joins with head 14 and has a cylindrical shape. In the embodiment shown in FIG. 1, shoulder 18 is cylindrically shaped with a smooth circular circumference. In another embodiment (as may be deduced from FIGS. 4A and 4B) shoulder 18 is octagonally shaped around its perimeter.

Figure 4A:
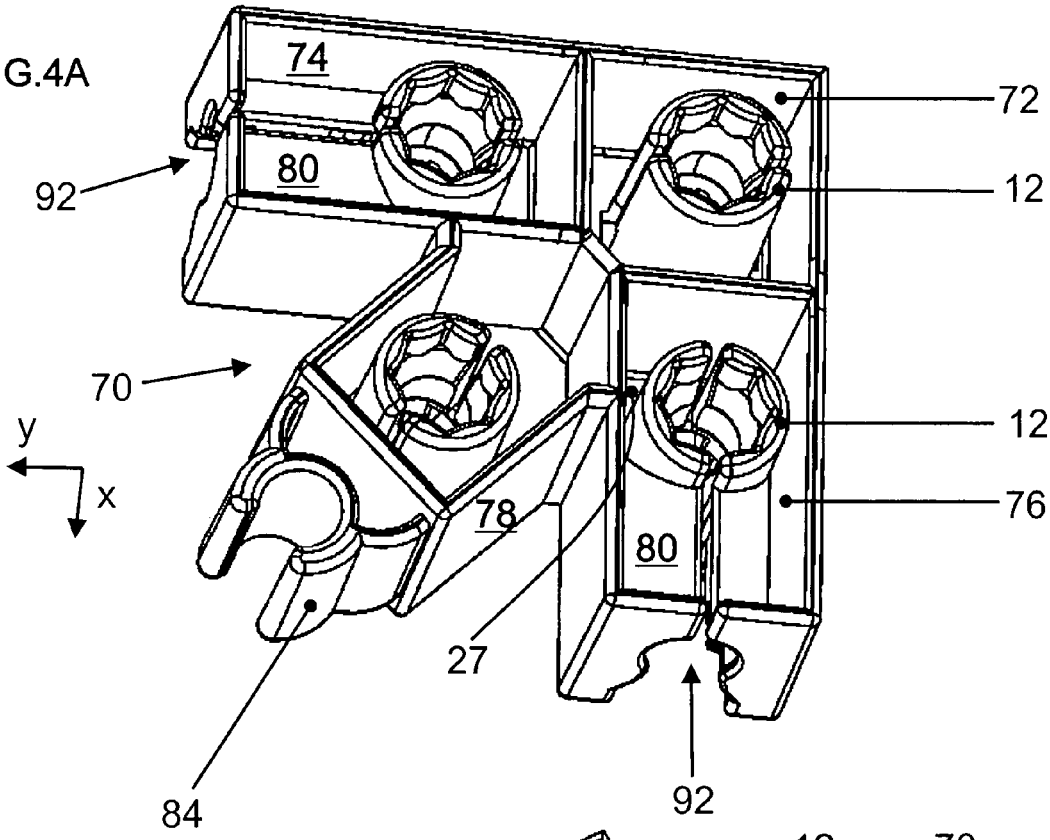
FIG. 4A shows an overhead upper view of an embodiment of an elbow component in accordance with the present invention.
Figure 4B:
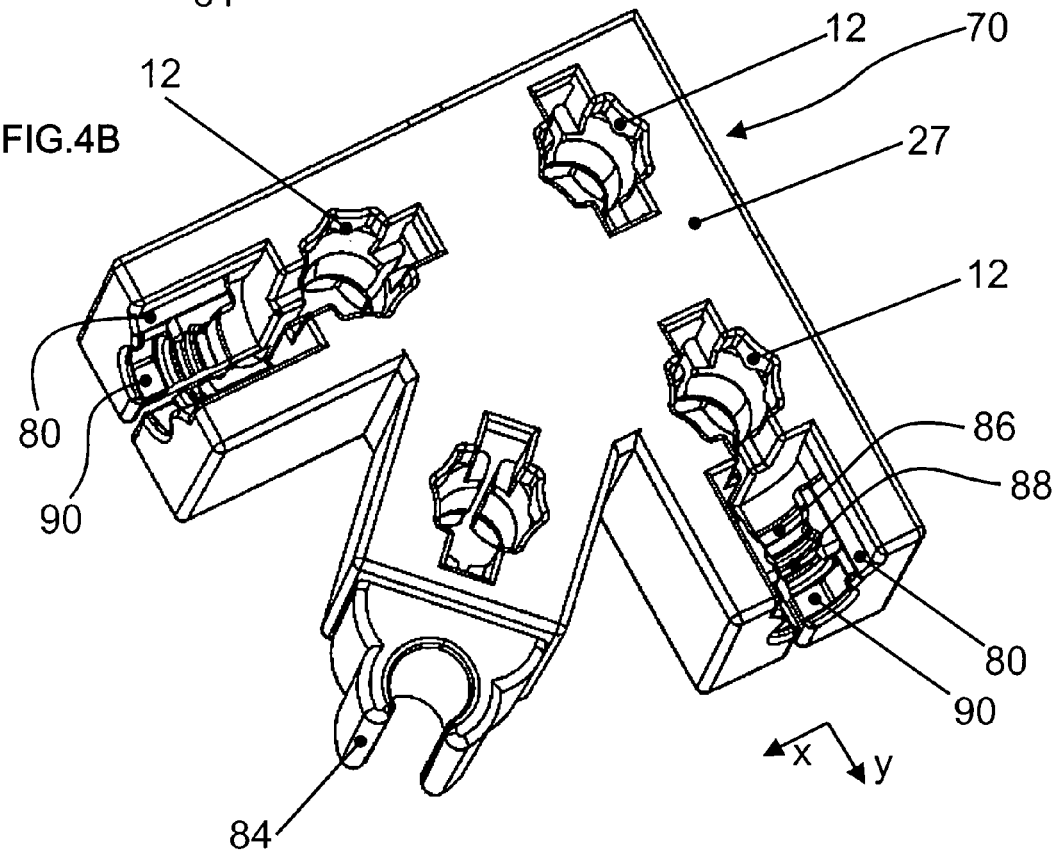
FIG. 4B shows an overhead rear view of an embodiment of an elbow component in accordance with the present invention.

Female bidirectional snap-lock connector 12 is formed with a rigid plastic wall that is generally cylindrically shaped with a hollow interior and extends upward from base 27. The interior of wall 28 is sized and proportioned to receive male snap-lock connector 10 when male connector 10 is inserted in the direction shown by the arrow and seated as shown with the dashed lined image of male connector 10. The interior of wall 28 includes head shaped region 30, neck shaped region 32, and shoulder shaped region 34. In one embodiment, shoulder shaped region 34 forms a octagonally shaped wall. Wall 28 includes one or more gaps (or regions of separation) extending longitudinally from upper region 36 (as shown in FIGS. 4A and 4B). In one embodiment, the gap extends near to base 27; and in another embodiment, the gap extends through base 27. The gap or gaps enable the interior of wall 28 to elastically expand (or deflect) as the head of male connector 10 is pushed through neck shaped region 32 and to substantially return to its original state once the head 14 of male connector 10 is lodged within the head shaped region 30 of female connector 12.

As the head 14 slips into the head shaped region 30, the shoulder 18 mates with the interior portion of wall 28 forming the shoulder shaped region 34. In the event that shoulder 18 has a octagonal shape, then male connector 10 is locked into a particular orientation with respect to female connector 12. The orientation of the mated connectors may be adjusted by axially twisting with a small amount of pressure to cause the faces of the octagonal shoulder 18 to shift with respect to the octagonal faces of the shoulder shaped region of wall 28. In the event that shoulder 18 is circular, then male connector 10 can spin freely around its axis within female connector 12.

It may further be appreciated that female connector 12 is bi-directional in that male connector 10 may be inserted from either the direction of base 27 or upper region 36. It may also appreciated that in the event that head region 30 is over-sized to provide for two heads 20, then two male connectors 10 may mate simultaneously with female 12. It may also be appreciated that while symmetrical octagonally shaped female shoulder cavities and corresponding male shoulder regions have been shown and described herein, other geometric shapes may be implemented including three, four, five, and n-sided shapes which may be symmetrical or asymmetrical, 'n' being an integer value. It may be further appreciated that while substantially sharp edges have been described herein, shapes with rounded edges are conceivable, such as, by example, a shamrock (four-sided) or cloverleaf (three-sided) shape.

As a further feature of the invention, it may be noted that the male and female components connect axially. This connection provides both axial and lateral support when the head lodges into position in the female head cavity and the neck cavity elastically contracts to surround the neck of the male.

Additionally, in the manufacturing process, plastic may be efficiently injected to produce male and female components. The components can be manufactured with simple 2-plate injection molds without the need for side core pulling. The injection molds can simultaneously produce multiple female connectors and associated components without the constraints imposed by the side-core pulling mechanisms.

Continuing to refer to FIG. 1, it may be appreciated that in the manufacturing process, a moving plate may be applied axially from the top and surrounding the volume to be filled by the female connector and the associated component, and, a base plate (ejector plate) may extend up from the base to fill the cavity of the lower shoulder, lower neck and head of the female connector. The moving plate inserts into the cavity to be formed between the upward reaching base portion of the component and the female external surface and also inserts into the shoulder and neck cavity of the female connector to be formed. The plastic may be injected into the volume including the female connector and associated component. When the injection molds opens, the moving plate is no longer pressing on the inner and outer surfaces of the component, allowing the supporting circular wings of the female cavity to deflect while the part is ejected from the plate.

Referring to FIG. 2, a second embodiment of female snap-lock connector 42 is shown fixed to and connected to base 43 in accordance with the present invention. Female connector 42 extends upward from base 43 and is tubular shaped with a spherical top portion. The interior of female connector 42 is hollow and the interior wall includes a spherically shaped head region 44, cylindrically shaped neck region 46, and sloping shoulder region 48. The interior wall of female connector 42 is shaped and proportioned to accommodate a male connector with a ball-shaped head. Gap 50 is shown separating opposing sides of the wall forming female connector 42. Gap 50 extends longitudinally towards base 43 sufficiently to enable the opposing walls of female connector 42 to elastically separate as the head of a male connector is pressed through neck region 46 and to spring back into position as the head of the male connector slips into head region 44 of female connector 42.

Referring to FIG. 3, female snap-lock connector 12 is shown with two alternative embodiment male snap-lock connectors 54, 56. Male snap-lock connectors 54, 56 have similar necks and shoulders as male connector 10. Heads 58, 60 of male connectors 54, 56 are mushroom-shaped and sized with an axial length of approximately ½ of head 14 of male connector 10 permitting both heads 58, 60 to share the cavity of head region 30 of female connector 12.

Referring to FIG. 4A, elbow component 70 is shown with four bidirectional female connectors 12 extending upward from base 27 in accordance with the present invention. (For frame of reference, the view shown in FIG. 4A is referred to as the upper view). Elbow component 70 has corner 72 joining arms 74, 76 which are fixed at a ninety degree angle with respect to each other. Elbow component 70 also includes a forty-five degree arm 78 which is spaced forty-five degrees from arms 74, 76 and on the x-y plane formed by arms 74, 76. A single female connector 12 extends upward from corner 72, arms 74, 76, and forty-five degree arm 78 such that male connectors (such as male connectors 54 shown in FIG. 3) may be mated with the upper end of female connectors 12 at a ninety-degree angle with respect to the x-y plane. Also, as may be seen by referring to FIG. 4B (for frame of reference referred to as the rearward view), male connectors (such as male connectors 56 shown in FIG. 3) may be simultaneously connected with the rearward end of female connectors 12.

Elbow component 70 includes two unidirectional female connectors 80 which respectively extend outward along arms 74, 76 in the x-y plane, such that male connectors (e.g. male connector 10, 54, or 56) may be snapped into position along the x-y plane.

Referring to FIGS. 4A, 4B, unidirectional female connector 80 includes head 86, neck 88, and shoulder 90. Female connector 80 has a gap 92 that extends longitudinally along the upward facing wall. Female connector 80 has an open surface joining with base 27. Head 86 and neck 88 of female connector 80 has inner walls that extend sufficiently (greater than 180 degrees) around the circumference of female connector 80 to permit a male connector to be pressed either longitudinally into or axially onto female connector 80 and to snap back into place once the male connector slips into the head, neck, and shoulder cavities of female connector 80. Additionally, the interior perimeter of shoulder 90 of female connector 80 is octagonally shaped to lock a male connector with a octagonally shaped exterior perimeter of its shoulder into a particular orientation with respect to the female connector. The orientation of the male connector can be changed by applying pressure axially to shift the orientation of the male shoulder with respect to the female shoulder.

Elbow component 70 includes female U-joint connector 84 extending outward from forty-five degree arm 78. The arms of female U-joint connector 84 are open sufficiently (less than one eighty degrees) to permit a shaft connector to be pressed between the open arms and oriented to snap back into place to grasp a shaft connector at a ninety degree angle with respect to the x-y plane. By mating with U-joint connector 84, a construction component with a mating male shaft connector can be attached to elbow connector 70 and rotate in the x-y plane. It may be appreciated that the U-joint connector 84 may alternatively be replaced by a male shaft connector or that the orientation of the connector with respect to the x-y plane may be disposed at a different angle (such as at a zero degree angle with respect to the x-y plane). Also, it may be appreciated that various combinations of female or male connectors may be implemented at the ends of the respective arms of elbow component 70 and that the representation shown in FIGS. 4A & 4B is simply one example.

Figure 5A:
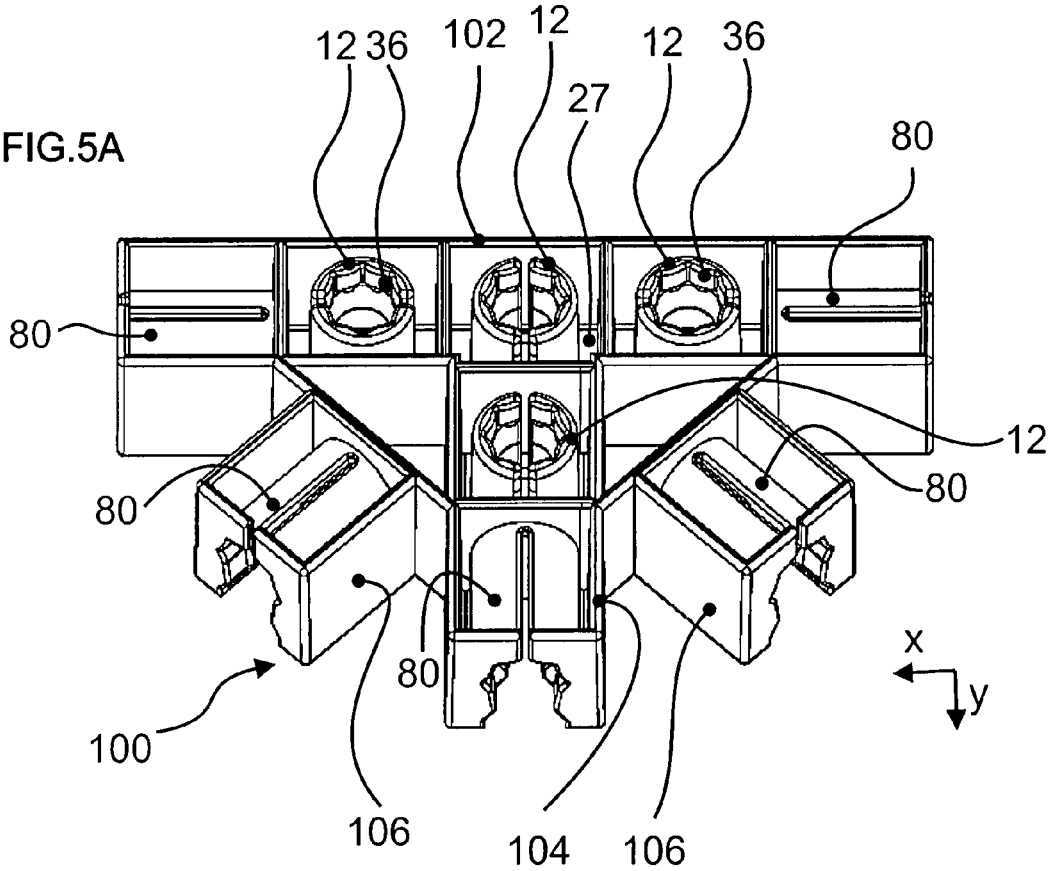
FIG. 5A shows an overhead upper view of an embodiment of a tee component in accordance with the present invention.

Referring to FIG. 5A, an upper view of tee component 100 is shown comprising two arms 102, 104 joined together in a tee in accordance with the present invention and describing an x-y plane. Arm 102 extends along the x-axis and includes three bi-directional female connectors 12 extending upward from base 27 and two unidirectional female connectors 80 extending from the ends of arm 102 along the x-axis. Arm 104 extends along the y-axis and includes one bidirectional female connector 12 extending upward from base 27 and one unidirectional female connector 80 extending from the end of arm 104 along the y-axis. Male connectors are insertable into female connectors 12 perpendicular to the x-y plane (z-axis); and, in the event that the shoulders of the male connectors are octagonally-shaped so they can mate with octagonally-shaped female shoulders 36, then the respective male connectors can be locked into a selected orientation with respect to the respective female connectors.

Tee component 100 also includes two forty-five degree arms 106 which are spaced forty-five degrees from arm 104 and on the x-y plane formed by arms 102, 104. Arms 102, 104, 106 include unidirectional female connectors 80 which respectively extend outward along each arm and in the x-y plane, such that male connectors (e.g. male connector 10, 54, or 56) may be snapped into position along the direction of the respective arm and in the x-y plane.

Figure 5B:
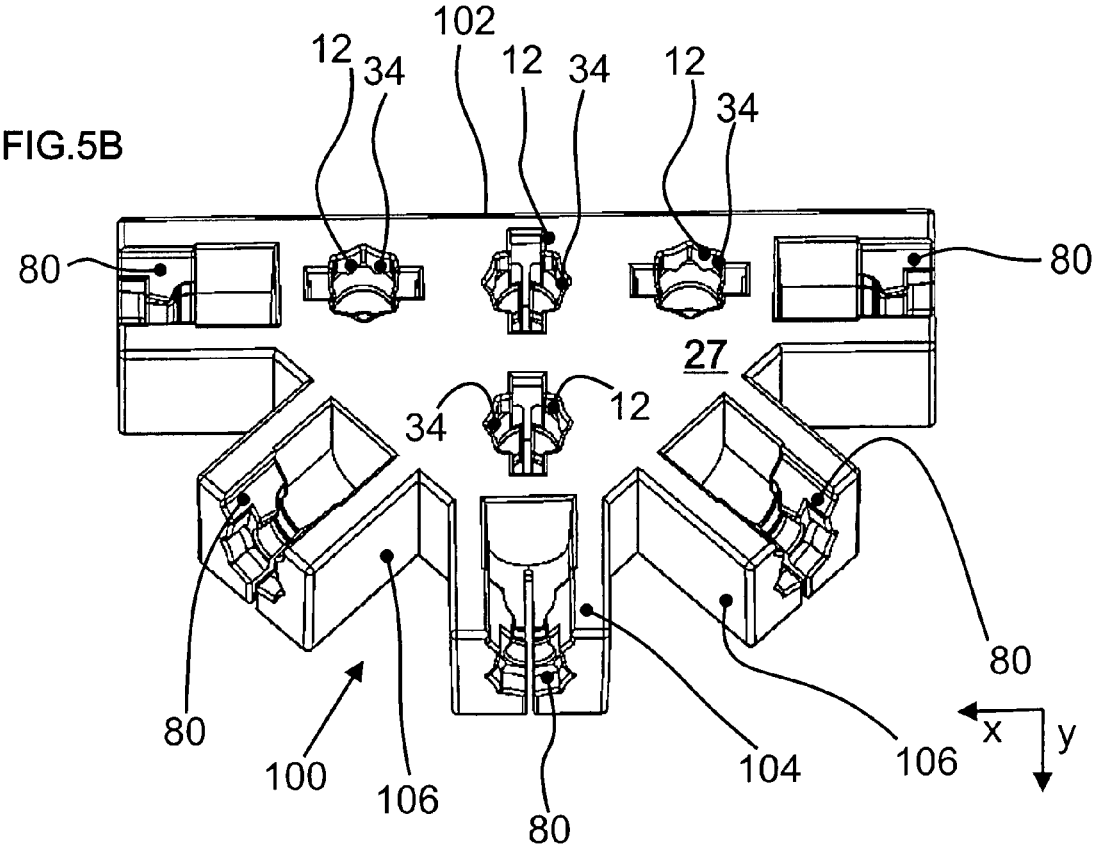
FIG. 5B shows an overhead rear view of an embodiment of a tee component in accordance with the present invention.

Referring to FIG. 5B, a rear view of an embodiment of tee component 100 shows octagonally-shaped shoulders 34 of female components 12 connected to base 27 and the open portion of unidirectional female connectors 80 in accordance with the present invention. With respect to the base end of female components 12, male components are insertable simultaneously with or independently of male components inserted from the upper face.

It may further be appreciated that various combinations and types of female or male connectors may be implemented at the ends of the respective arms of tee component 100 and that the representation shown in FIGS. 5A & 5B is simply one example. Also, fewer bi-directional female connectors 12 may be incorporated in alternative embodiments.

Figure 6A:
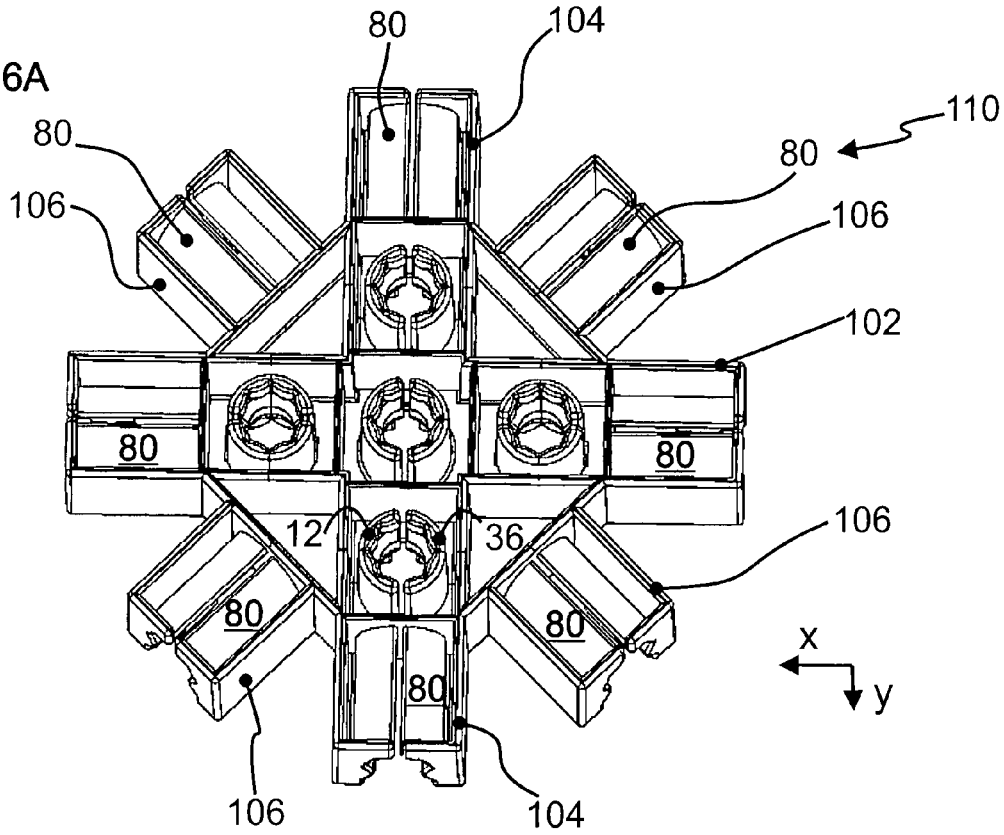
FIG. 6A shows an overhead upper view of an embodiment of a star component in accordance with the present invention.

Referring to FIG. 6A, an upper view of star component 110 is shown comprising arm 102 and two arms 104 joined together in a cross in accordance with the present invention and describing an x-y plane. Star component 110 also includes four forty-five degree arms 106 which are spaced forty-five degrees from arms 102, 104 and on the x-y plane formed by arms 102, 104. Arms 102, 104, 106 include unidirectional female connectors 80 which respectively extend outward along each arm and in the x-y plane, such that male connectors (e.g. male connector 10, 54, or 56) may be snapped into position along the direction of the respective arm and in the x-y plane.

Figure 6B:
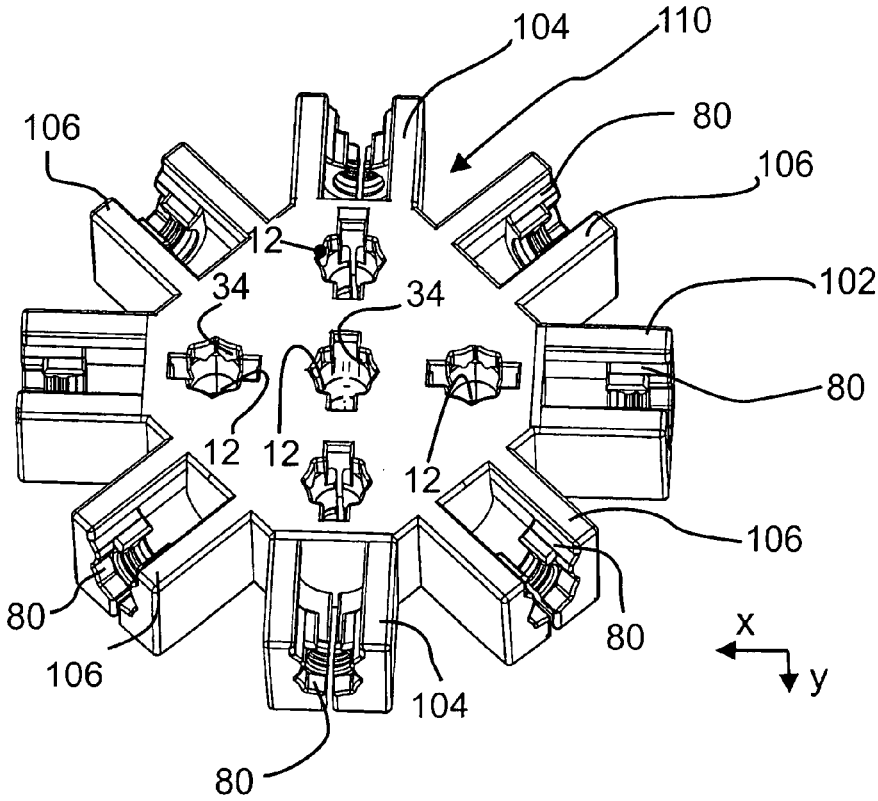
FIG. 6B shows an overhead rear view of an embodiment of a star component in accordance with the present invention.

Referring to FIG. 6B, a rear view of an embodiment of star component 110 shows octagonally-shaped shoulders 34 of female components 12 connected to base 27 and the open portion of uni-directional female connectors 80 in accordance with the present invention.

It may further be appreciated that various combinations and types of female or male connectors may be implemented at the ends of the respective arms of star component 110 and that the representation shown in FIGS. 6A & 6B is simply one example. Also, fewer bidirectional female connectors 12 may be incorporated in alternative embodiments.

Figure 7A:
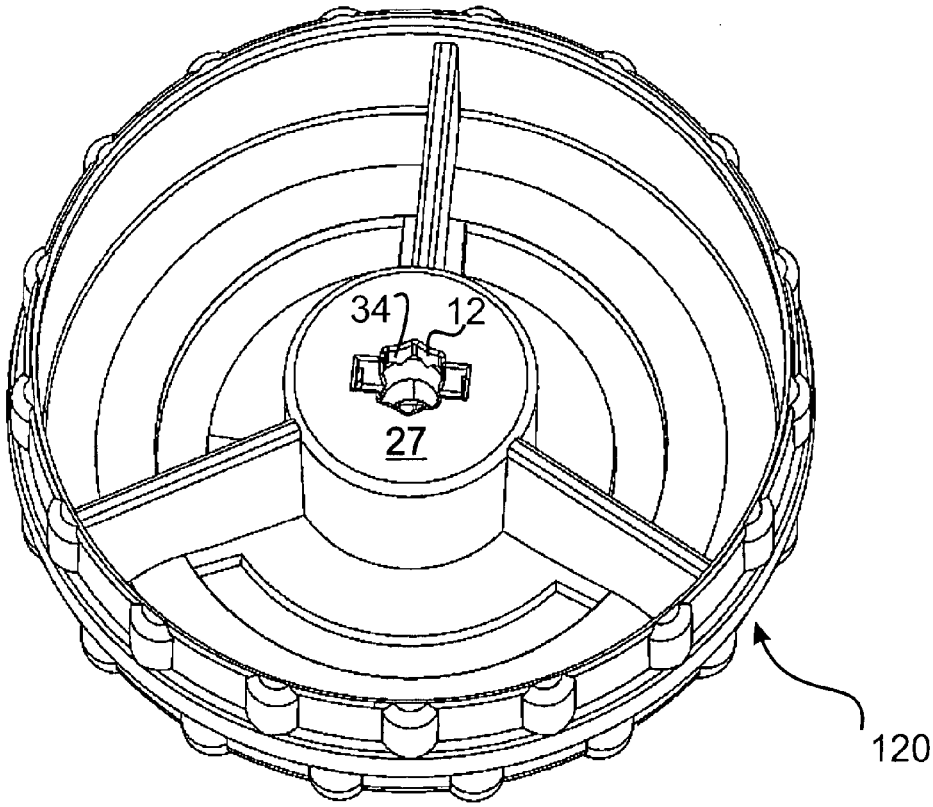
FIG. 7A shows an overhead inside view of an embodiment of a wheel component in accordance with the present invention.

Referring to FIG. 7A, the inner surface of wheel component 120 is shown with exposed base 27 centered at the axle and bi-directional female connector 12 extending axially from base 27 towards the external surface of wheel component 120 in accordance with the present invention. Shoulder 34 of female connector 12 is octagonally shaped for mating with a male connector (e.g. male connector 10, 54, or 56) with a rounded or octagonally shaped shoulder depending on whether wheel component 120 is to be freely turning or in fixed orientation with the male connector.

Figure 7B:
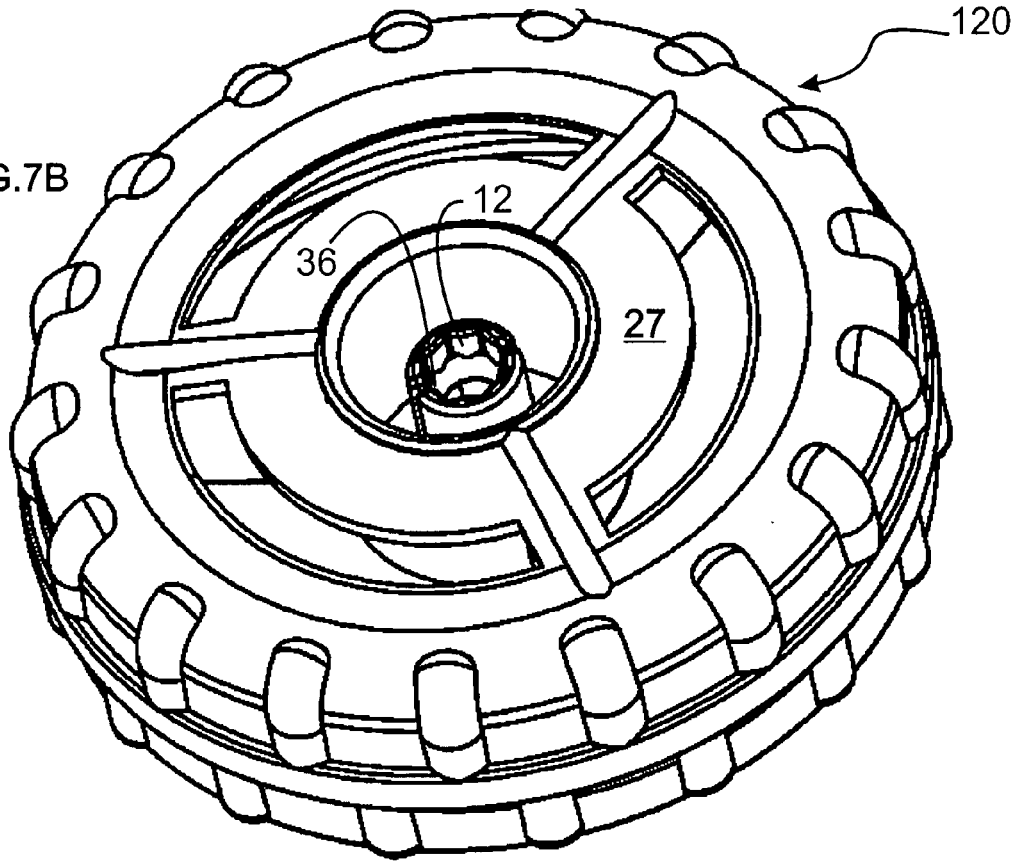
FIG. 7B shows an overhead external view of an embodiment of a wheel component in accordance with the present invention.

Referring to FIG. 7B, the external surface of wheel component 120 is shown with female connector 12 extending axially from base 27 in accordance with the present invention. Female shoulder 36 is octagonally-shaped for mating and fixing the orientation of a male connector with a octagonally-shaped shoulder mounted onto female connector 12 through the upper portion.

It may be further appreciated that various alternate connectors may be implemented as a connector for wheel component 120, such as implementing a uni-directional female or male connector in place of bi-directional female connector 12 or combinations thereof.

Figure 8A:
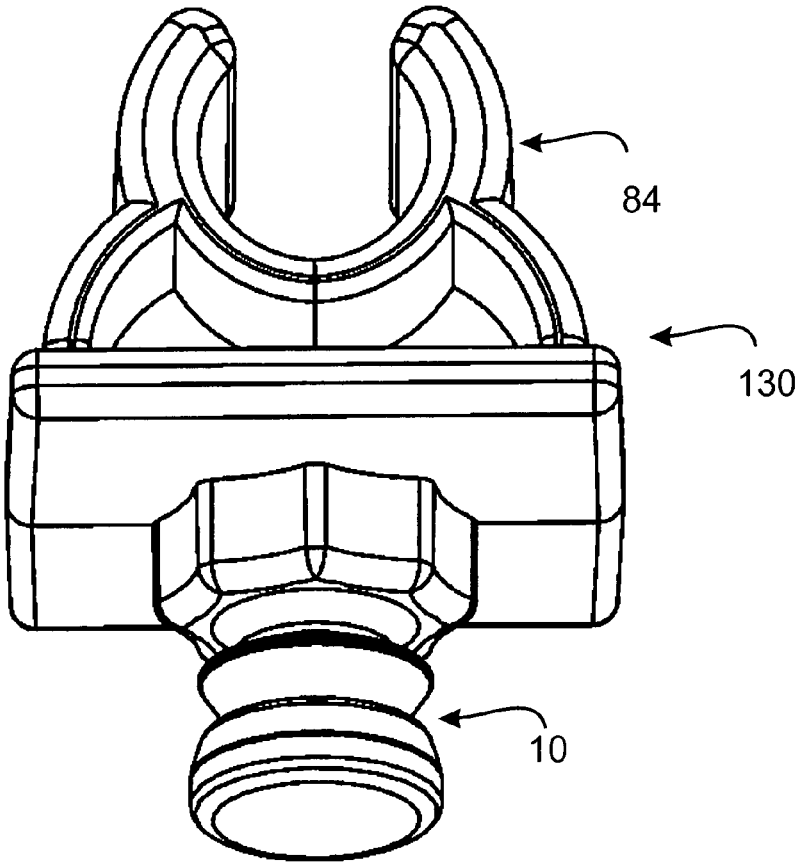
FIG. 8A shows a first side view of an embodiment of a base component in accordance with the present invention.
Figure 8B:
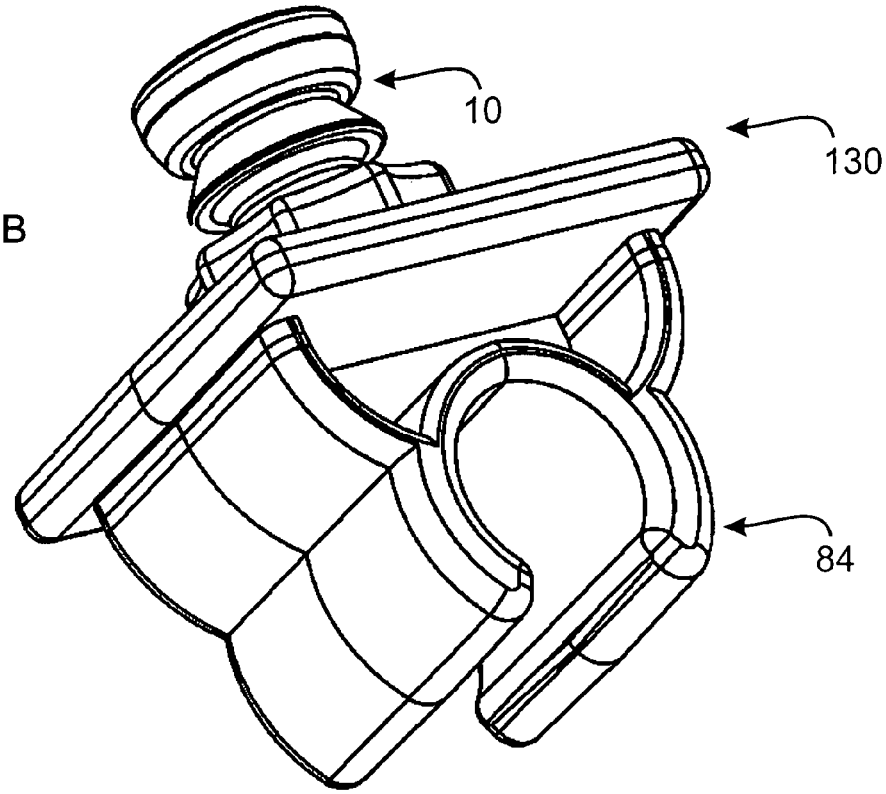
FIG. 8B shows a second side view of an embodiment of a base component in accordance with the present invention.

Referring to FIGS. 8A and 8B, base component 130 is shown with male connector 10 extending axially from a first side of base 27 and female U-joint connector 84 extending axially from an opposite side of base 27 in accordance with the present invention.

Figure 9A:
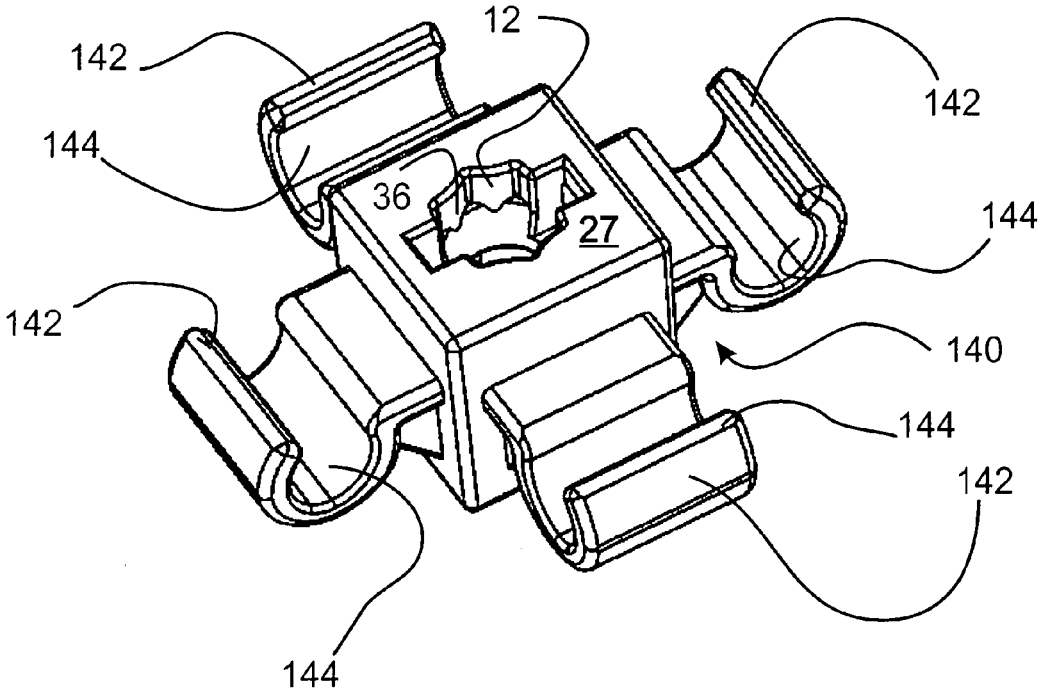
FIG. 9A shows an overhead rear view of an embodiment of a quad-base component in accordance with the present invention.

Referring to FIG. 9A, a rear view of quad-base component 140 is shown with female connector 12 extending axially from base 27 and four female U-joint connectors 142 extending outward from the center axis in accordance with the present invention. Female shoulder 36 is octagonally-shaped for mating and fixing the orientation of a male connector mounted onto female connector 12 through the upper portion and having a octagonally-shaped shoulder. The U-portion of U-joint connectors 142 include an inner surface 144 that extends circumferentially greater than 180 degrees in order to grasp an inserted axle or other mate-able connector.

Figure 9B:
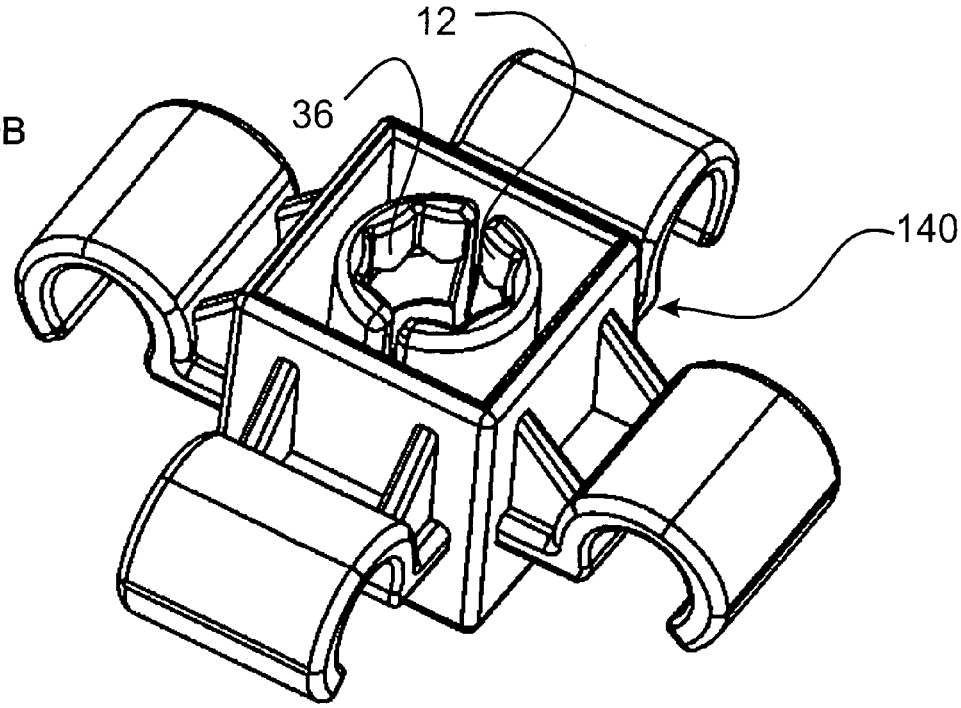
FIG. 9B shows an overhead upper view of an embodiment of a quad-base component in accordance with the present invention.

Referring to FIG. 9B, an upper view of quad-base component 140 is shown with female connector 12 extending axially from base 27 in accordance with the present invention. Female shoulder 36 is octagonally-shaped for mating and fixing the orientation of a male connector with a octagonally-shaped shoulder mounted onto female connector 12 through the upper portion in accordance with the present invention.

It may be further appreciated that various alternate connectors may be implemented with quad-base component 140 or that the U-joint connectors may be oriented with different angular relations to the axis of female connector 12.

Figure 10A:
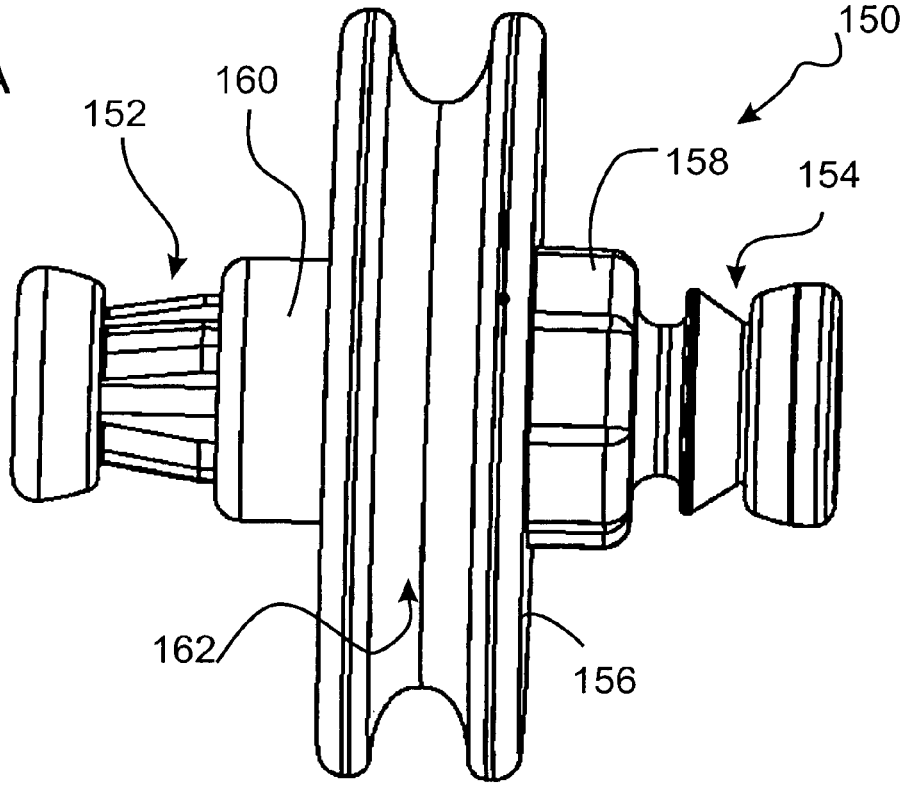
FIG. 10A shows an overhead view of an embodiment of a pulley component in accordance with the present invention.
Figure 10B:
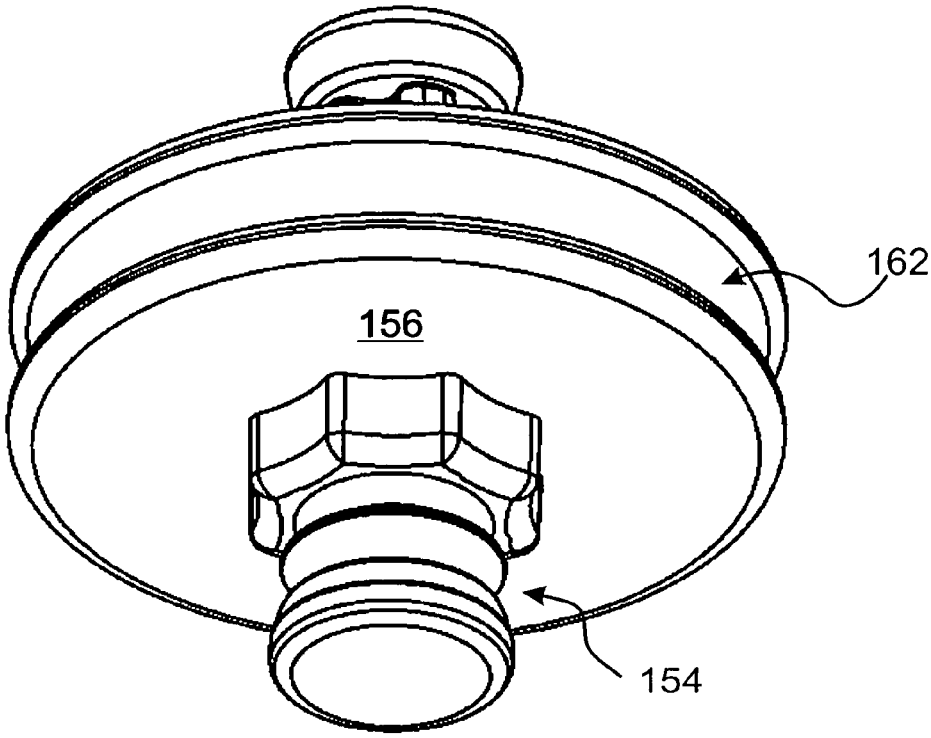
FIG. 10B shows a side view of an embodiment of a pulley component in accordance with the present invention.

Referring to FIGS. 10A and 10B, a pulley component 150 is shown including male connectors 152, 154 connected axially and perpendicular to the plane described by base 156 in accordance with the present invention. Octagonally shaped shoulder 158 of male connector 154 may be mated with a octagonal shaped shoulder of a female connector to lock a particular orientation between mated connectors. Smooth circular shaped shoulder 160 of male connector 152 permits male connector 152 to be mated with a female connector and freely rotate with respect to the female connector while pulley component 150 is supported by components with corresponding female connectors. Base 156 has a concave surface 162 along its circular perimeter for retaining a line (or cable, chain, thread, cord, belt, rubber band or similar article) for operation with pulley component 150.

Figure 11A:
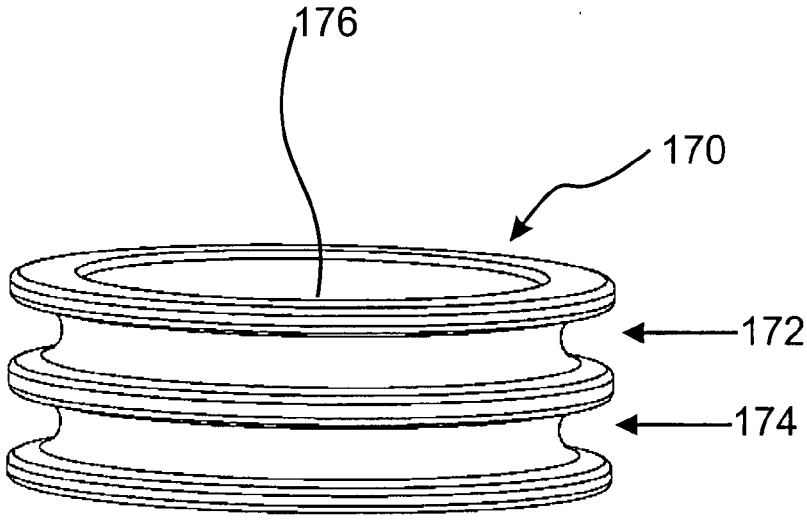
FIG. 11A shows an overhead view of an embodiment of a dual pulley component in accordance with the present invention.
Figure 11B:
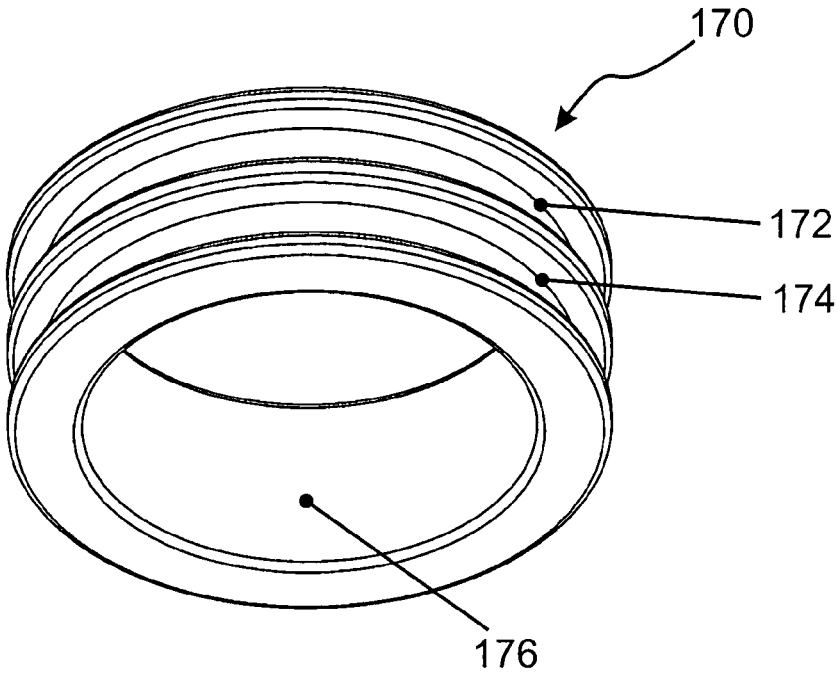
FIG. 11B shows a side view of an embodiment of a dual pulley component in accordance with the present invention.

Referring to FIGS. 11A and 11B, dual pulley component 170 is shown with two parallel concave shaped perimeter surfaces 172, 174 for retaining respective lines (as described by example above) and a hollow center described a smooth interior surface 176 in accordance with the present invention. Smooth interior surface 176 enables dual pulley component 170 to be mounted and supported for free rotation in accordance with the demands of attached lines.

Figure 12A:
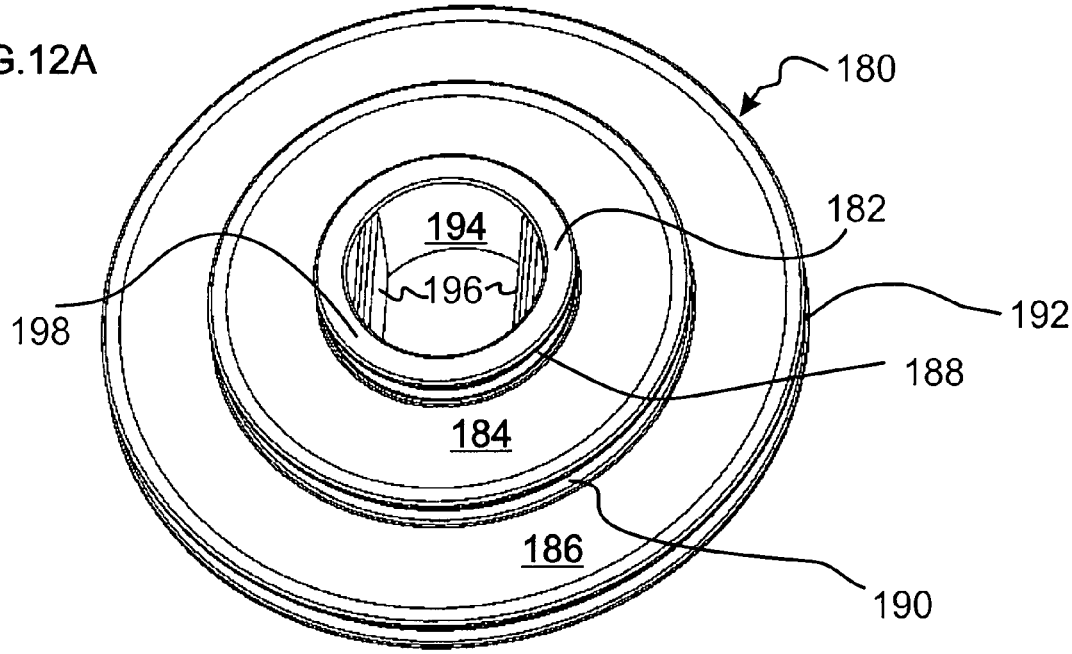
FIG. 12A shows an overhead upper view of an embodiment of a triple pulley component in accordance with the present invention.
Figure 12B:
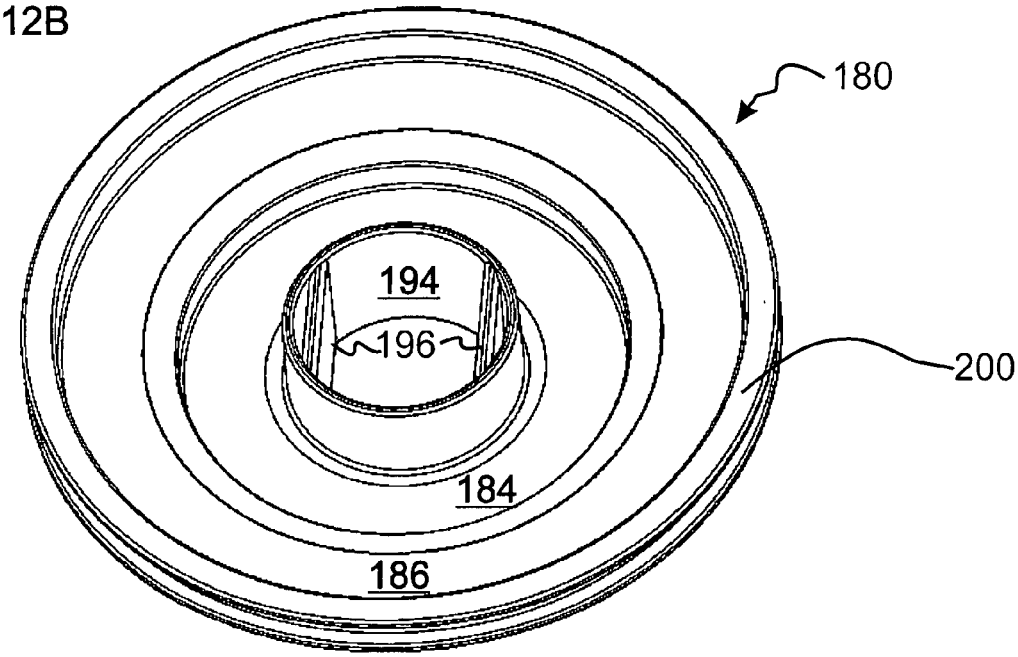
FIG. 12B shows an overhead inner view of an embodiment of a triple pulley component in accordance with the present invention.

Referring to FIGS. 12A and 12B, triple pulley component 180 is shown with three axially centered pulleys 182, 184, 186 having successively increasing diameters in accordance with the present invention. Pulleys 182, 184, 186, respectively include concave shaped perimeter surfaces 188, 190, 192 for retaining respective lines (as described by example above). Triple pulley component 180 includes a smooth interior surface 194 with two parallel struts 196 connected to the inner surface such that triple pulley component 180 can be mounted in fixed relation onto another component that is sized and proportioned to abut the surfaces of the rods. Smooth interior surface 194 has a depth that extends from the top surface 198 of pulley 182 to the bottom surface 200 of pulley 186 such that axial support is provided to each pulley. It may be appreciated that the combination of interior surface 194 and struts 196 provide a slot opening such that triple pulley component can be adjustably connected with another component upon which triple pulley component is mounted.

Figure 13A:
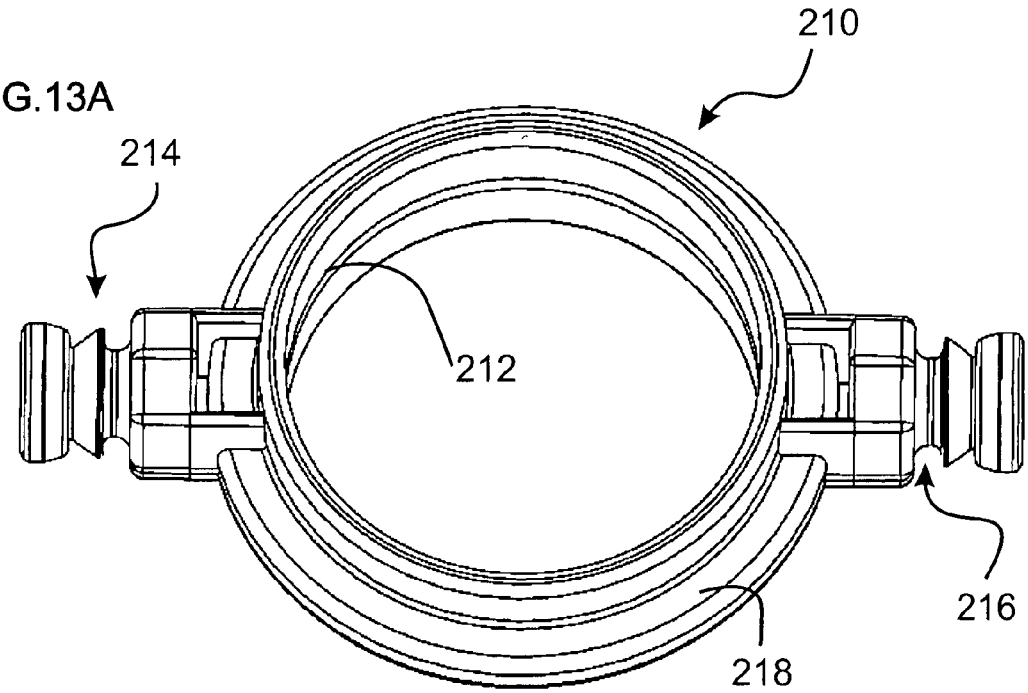
FIG. 13A shows an overhead view of an embodiment of a roto-base component in accordance with the present invention.
Figure 13B:
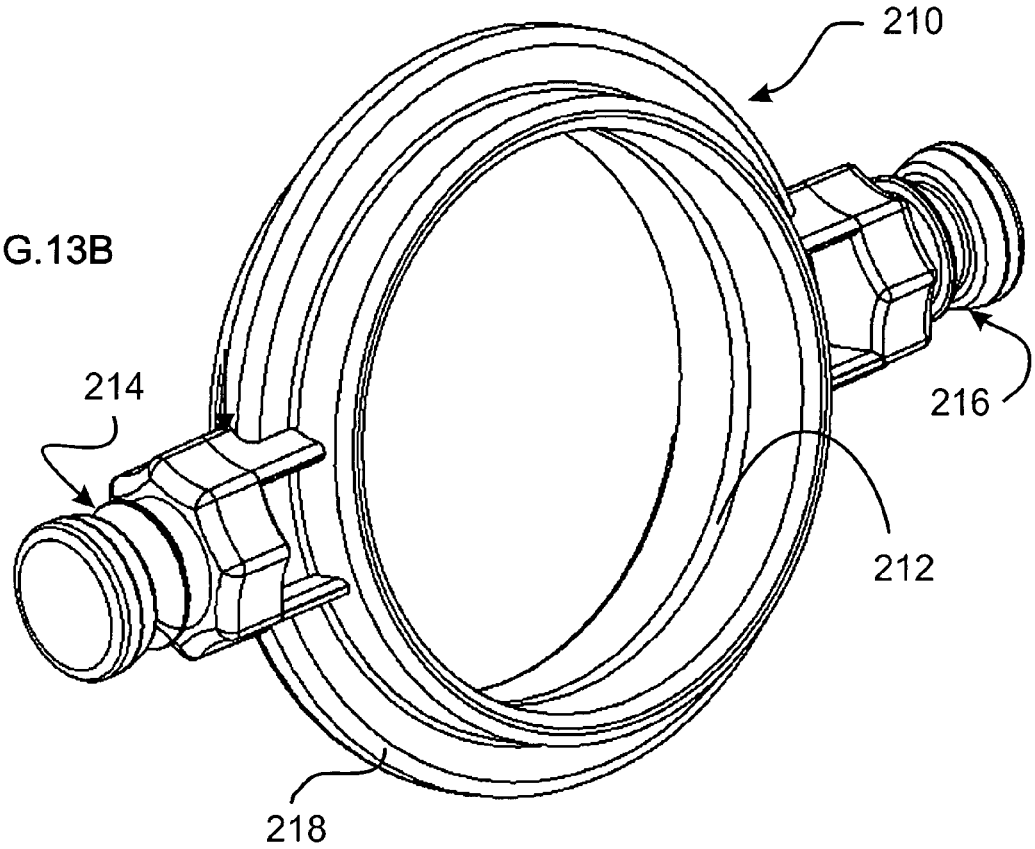
FIG. 13B shows a side view of an embodiment of a roto-base component in accordance with the present invention.

Referring to FIGS. 13A and 13B, roto-base component 210 is shown with a central interior surface 212 describing a circular opening and two male connectors 214, 216 extending on a common axis from oppositely disposed portions of external surface 218 in accordance with the present invention. Octagonally shaped shoulders of male connectors 214, 216 enable respective female components to mate in a fixed orientation. Central interior surface 212 enables roto-base component 210 to freely rotate when mounted and includes a sufficient width to form a ring and provide axial and transverse axis support (e.g. circular opening is sized ¾" and interior surface width is ¼").

Figure 14A:
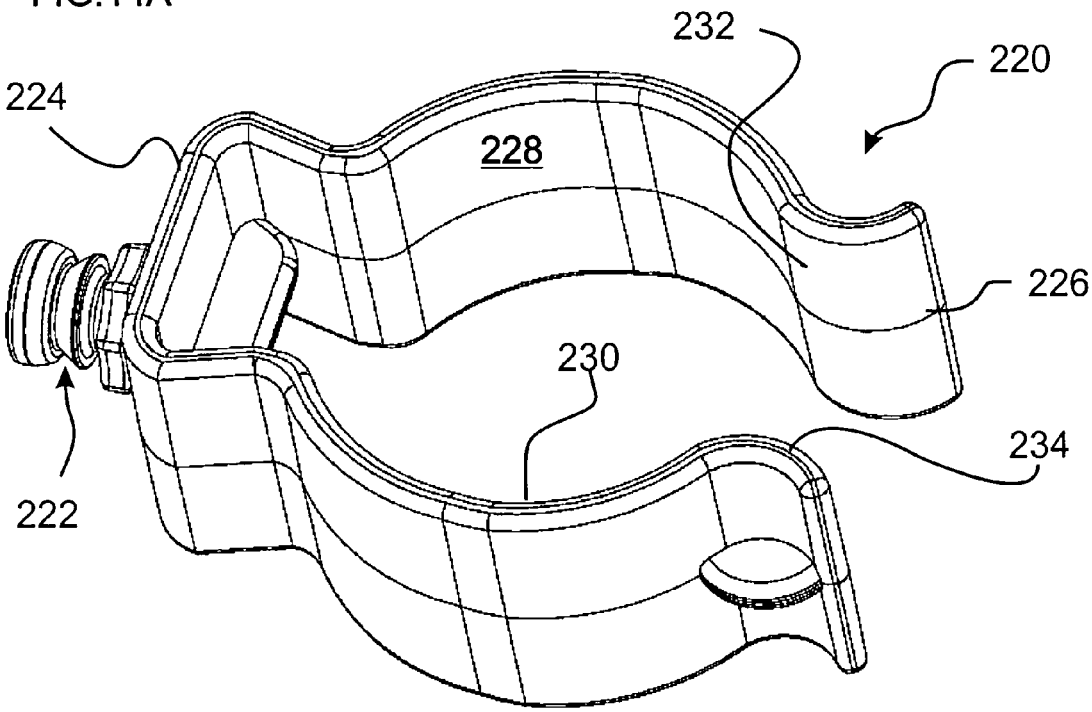
FIG. 14A shows a first side view of an embodiment of a motor-base component in accordance with the present invention.
Figure 14B:
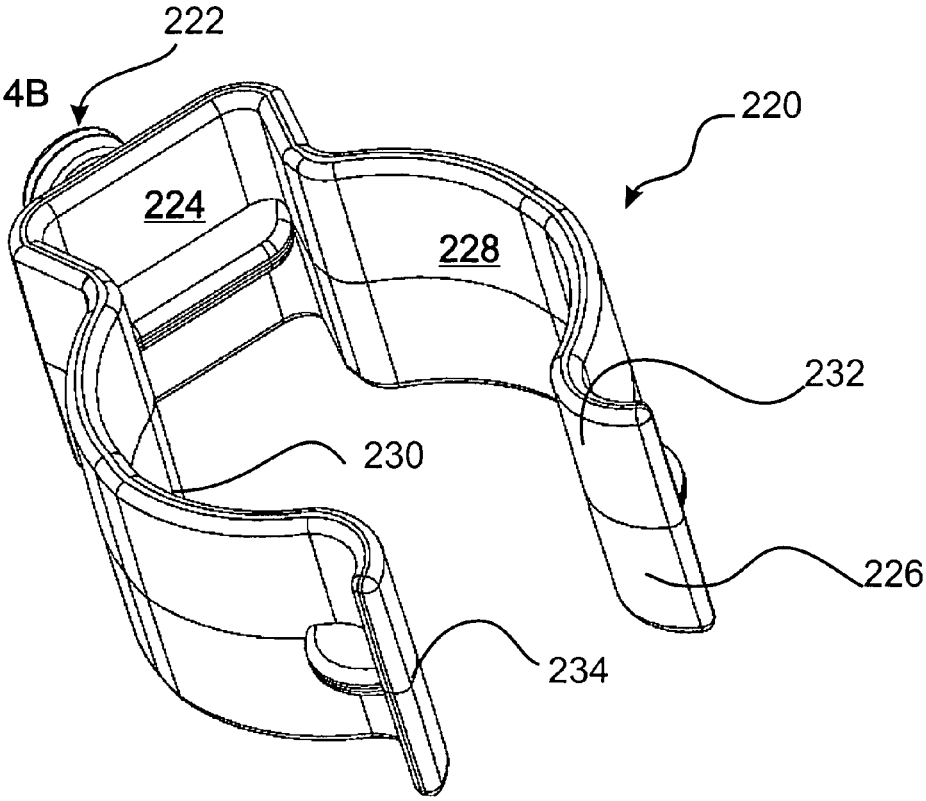
FIG. 14B shows a second side view of an embodiment of a motor-base component in accordance with the present invention.

Referring to FIGS. 14A and 14B, motor-base component 220 is shown with male connector 222 connected to base 224 of clip 226 in accordance with the present invention. Clip 226 includes semi-circular surfaces 228, 230 for cradling and gripping another component such as a motor or transmission. Semi-circular surfaces by example may be sized to surround an object of 1" diameter and have a depth of ½" to provide axial and lateral support to a mounted object. Semi-circular surfaces 228, 230 include ends 232, 234 which may elastically be widened to enable insertion of the object to be mounted.

Referring to FIGS. 15A and 15B, swing-rod component 240 is shown including two bi-directional female components 12 extending upward from base 27, unidirectional female connector 80 extending from one end, and axle connector 242 extending from the other end in accordance with the present invention.

Referring to FIGS. 16A and 16B, angle-rod component 260 is shown including rod portion 262 with two bidirectional female components 12 extending upward from base 27 and unidirectional female connector 80 extending open at end 264 and including angled rod portion 266 disposed at an angle with respect to the axis of rod portion 262 in accordance with the present invention. Male connector 268 extends from end 270. By example, a selected angle may be 30, 45, 60 degrees.

Referring to FIG. 17A, large M-F rod component 280 is shown with multiple bi-directional female connectors extending upward from base 27 and male connector 282 and unidirectional female connector 12 extending from respective ends in accordance with the present invention.

Figure 18A:
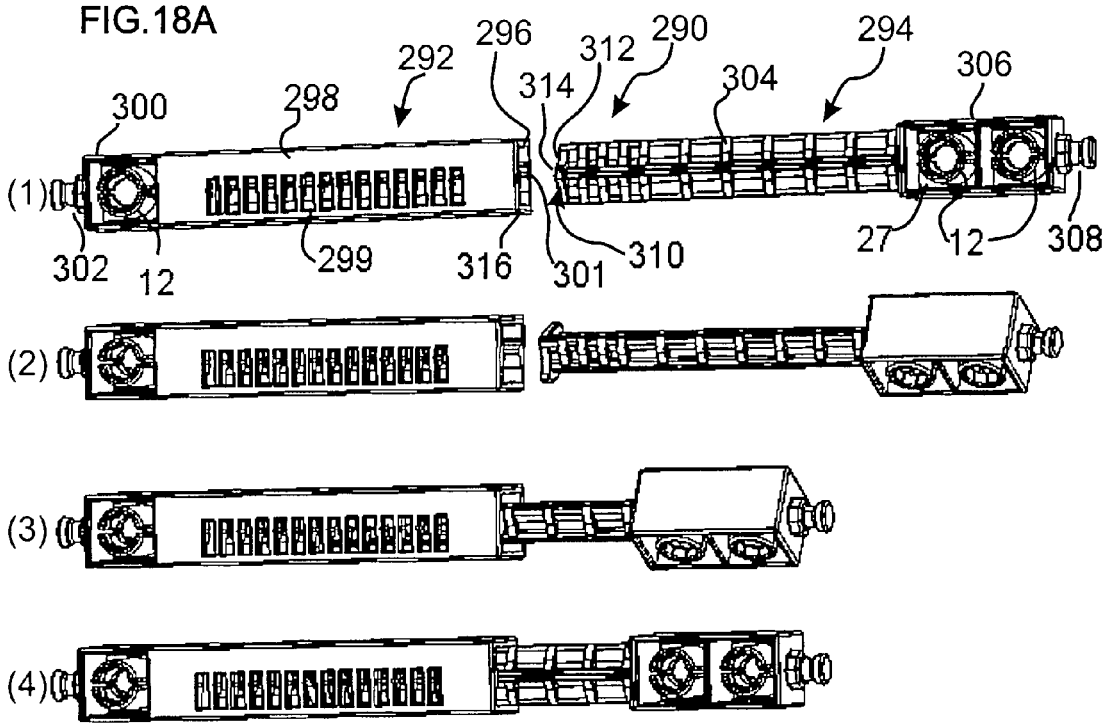
FIG. 18A shows a first side view of an embodiment of an expandable M-M rod component in accordance with the present invention.
Figure 18B:
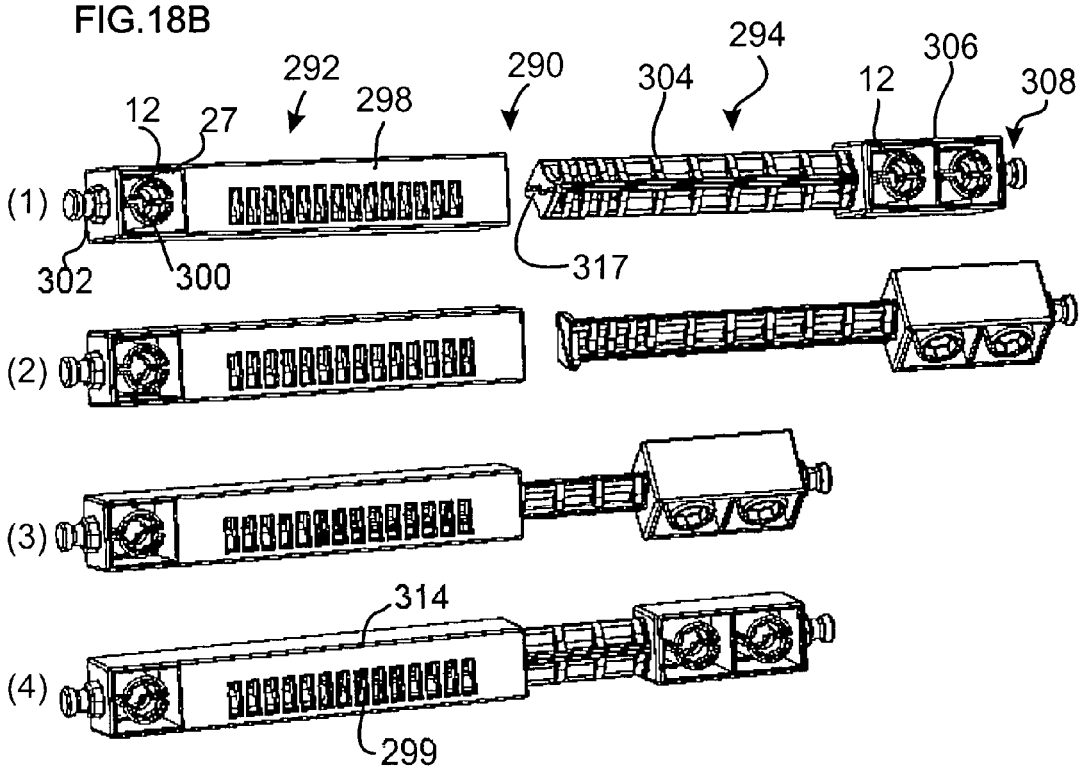
FIG. 18B shows a second side view of an embodiment of an expandable M-M rod component in accordance with the present invention.

Referring to FIGS. 18A and 18B, expandable M-M rod component 290 is shown with multiple representations of adjustable rod sections 292, 294 demonstrating the connection states of the respective sections in accordance with the present invention. Rod section 292 includes open end 296, vent section 298, and end section 300. Vent section 298 is shaped rectagonally and includes two series of vents 299 and centrally disposed ridges 301 extending in parallel relation on opposite sides. End section 300 includes bi-directional female connector 12 extending upward from base 27 and male connector 302 extending axially. Rod section 294 includes insertable expansion section 304 and end section 306. End section 306 includes two bidirectional female connectors 12 extending upward from base 27 and male connector 308 extending axially. Expansion section 304 includes a parallelogram-like shaped tip 310 disposed with its longer axis extending parallel with the axis of bidirectional female connectors 12. Parallelogram-like shaped tip 310 including two opposite sides 312 with concave perimeters.

Image (1) and (4) of FIGS. 18A and 18B show the orientation of rod sections 292, 294 when connected and locked into position. Image (2) and (3) show the orientation of rod sections 292, 294 in order to in order to unlock the two sections and to adjust the extension of expandable M-M rod component 290. When oriented in position (2) and (3), vertex 314 of tip 310 is oriented with vertex 316 of open end 296 and concave sides 312 are oriented with disposed ridges 301 so that rod section 294 can slide freely in and out of rod section 392. Rod section 294 is locked into place by twisting the rod clock-wise when vertex 314 abuts one of the series of vents 299 and by sliding vertex 314 into the cavity of vent 299 as may best be seen in image (4). When locked into place, each of the female connectors 12 from both rod sections are aligned in parallel.

Figure 19A:
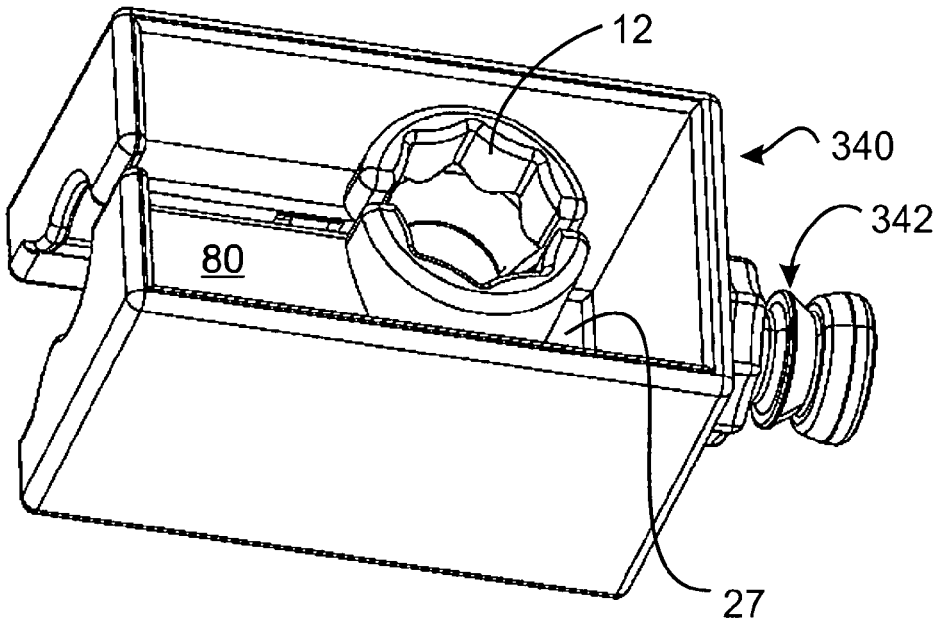
FIG. 19A shows an overhead upward view of an embodiment of a short M-F rod component in accordance with the present invention.
Figure 19B:
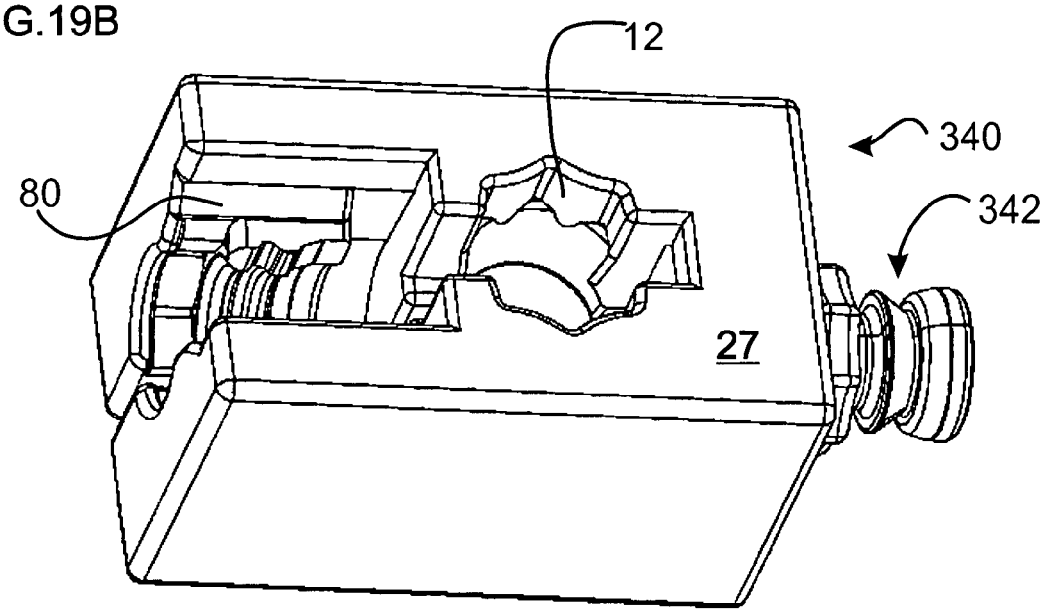
FIG. 19B shows an overhead rear view of an embodiment of a short M-F rod component in accordance with the present invention.

Referring to FIGS. 19A and 19B, short M-F rod component 340 is shown with bi-directional female connector 12 extending from base 27, unidirectional female connector 80 extending from one end, and male connector 342 extending axially from the other end in accordance with the present invention.

Figure 20A:
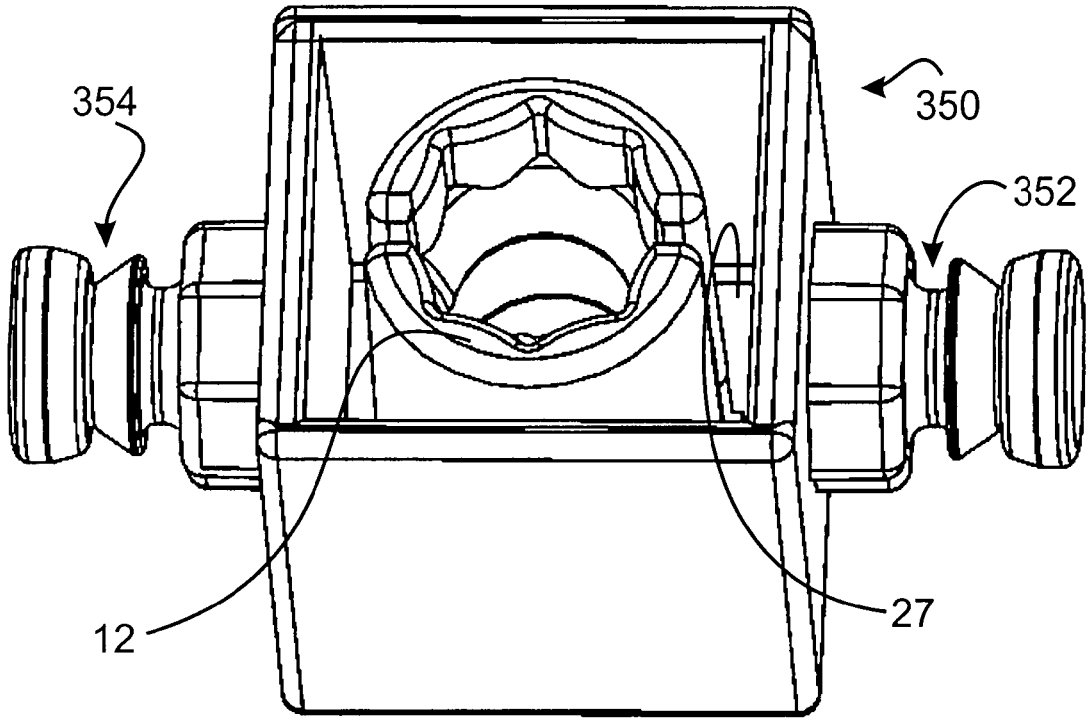
FIG. 20A shows an overhead upward view of an embodiment of a short M-M rod component in accordance with the present invention.
Figure 20B:
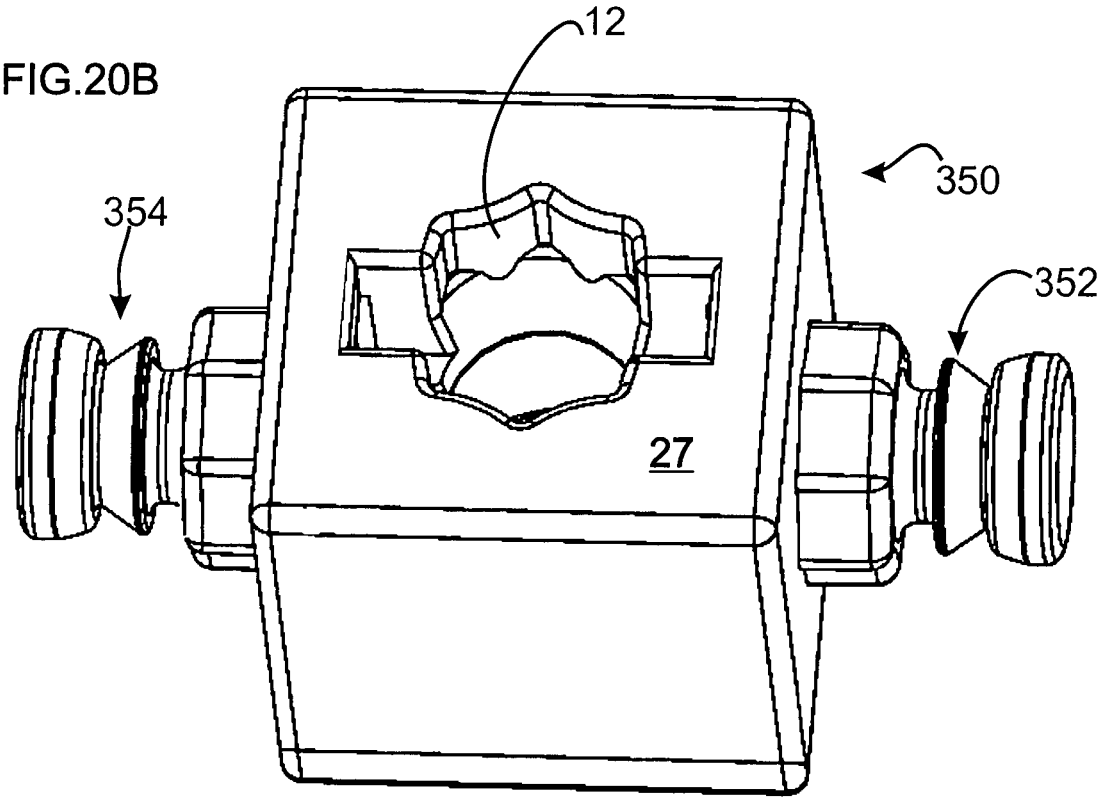
FIG. 20B shows an overhead rear view of an embodiment of a short M-M rod component in accordance with the present invention.

Referring to FIGS. 20A and 20B, short M-M rod component 350 is shown with bi-directional female connector 12 extending from base 27 and two male connectors 352, 354 extending axially from opposite ends in accordance with the present invention.

Figure 21:
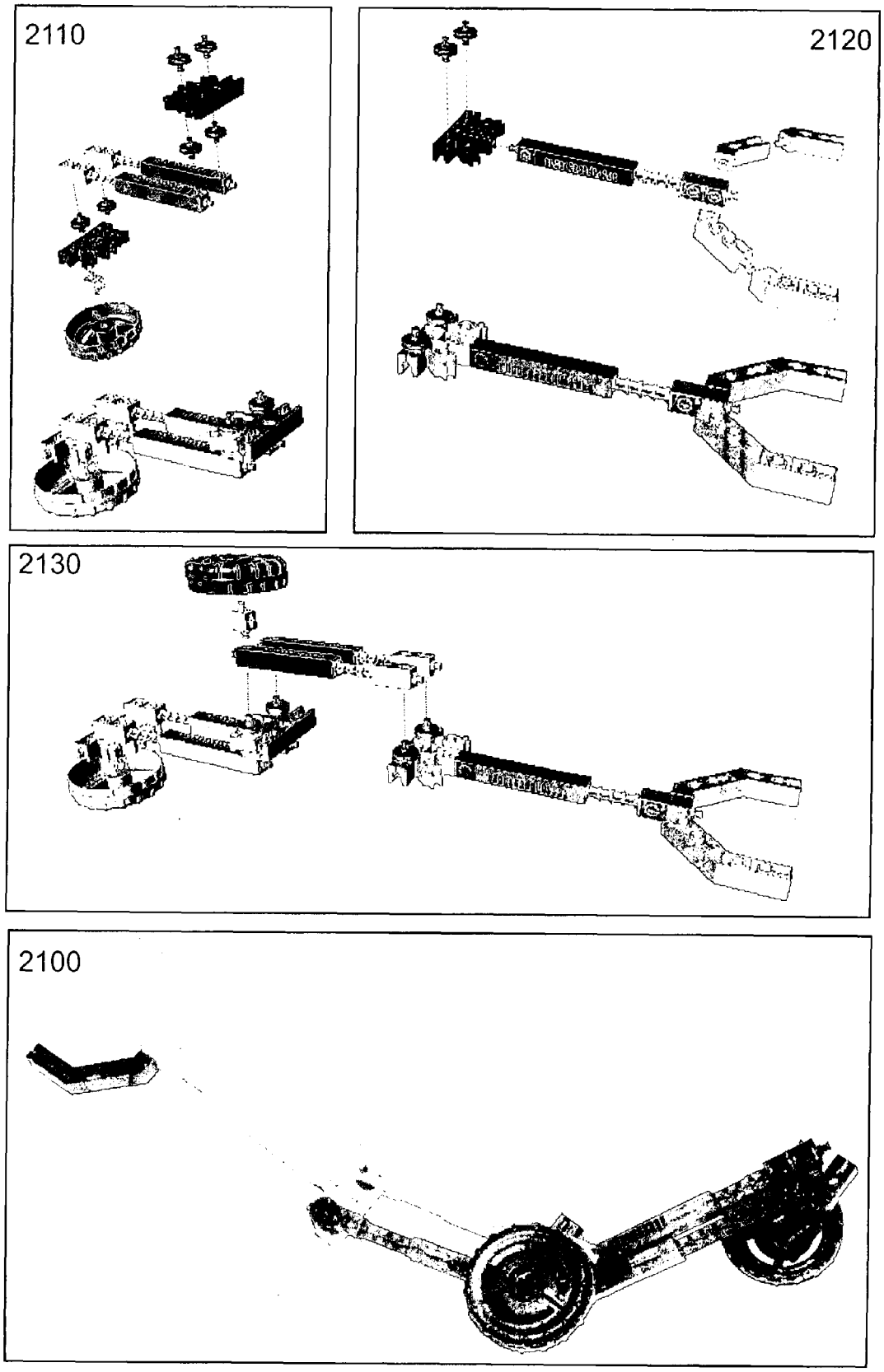
FIG. 21 shows a composite of parts and assembly steps generating a toy construction vehicle in accordance with the present invention.

Referring to FIG. 21, toy bi-ped vehicle 2100 is shown assembled from components herein described in accordance with the present invention. Step 1 (2110) in FIG. 21 shows the layered combination of wheel 120 mated with pulley 150, mated with tee 100, mated with two pulleys 150, mated with two expandable rods 290, mated with two pulleys 150, mated with tee 100, and mated with two pulleys to produce a multi-rotational section. Step 2 (2120) in FIG. 21 shows the combination of two pulleys 150 with tee 100, mated with expandable rod 290, mated with oppositely disposed angle rods 260, and mated with two additional angle rods 260 producing a second section. Step 3 (2130) in FIG. 21 shows the joining of the two sections with two expandable rods 290, mated with small M-M rod 350, and mated with wheel 120 to generate toy bi-ped vehicle 2100.

Figure 22:
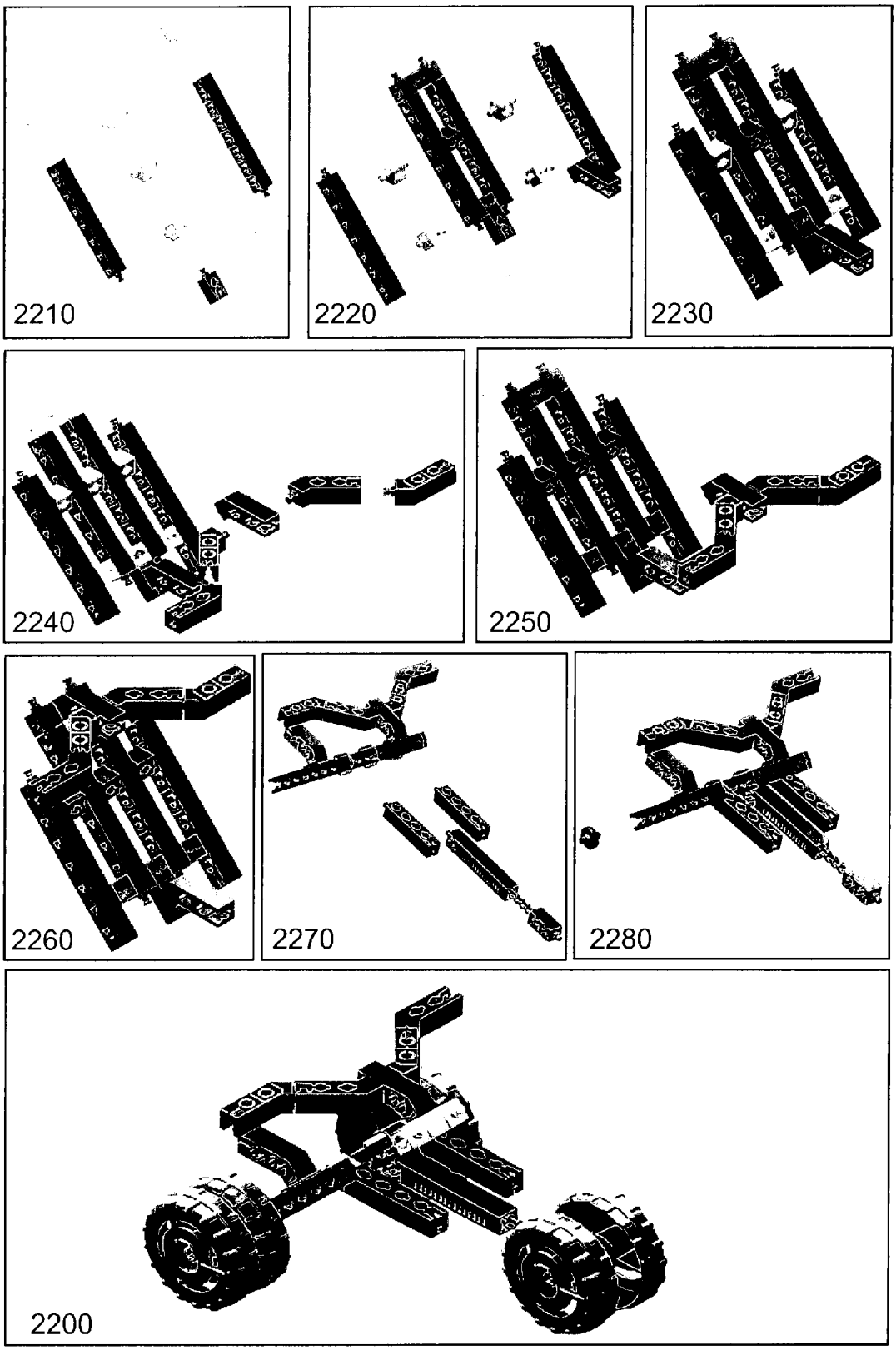
FIG. 22 shows a composite of parts and assembly steps generating a toy tricycle in accordance with the present invention.

Referring to FIG. 22, toy tricycle 2200 is shown assembled from components herein described in accordance with the present invention. Step 1 (2210) in FIG. 22 shows the combination of two big rods 280 with two small M-M rods 350, mating of two M-M rods 350 with unidirectional female connectors of big rods 280, mating of small M-M rod 350 with the two small M-M rods 350, and mating small M-F rod 340 with small M-M rod 350 connected at the lower end of big rods 280 to generate a first main frame section. Step 2 (2220) in FIG. 22 shows the combination of two more big rods 280 with the first main frame section using two pairs of small M-M rods 350 and the mating of angle rod 260 with bi-directional female connector 12 of small M-F rod 340 to generate a second main frame section (2230). Step 3 (2240 and 2250) shows the combination of six angle rods 260 to generate a pair of handle bars which are mated with bidirectional female connector 12 of small M-M rod 350 located at the upper portion of main frame section to generate the third main frame section (2260). Step 4 (2270) shows the combination of expandable rod 290 and two large M-F rods with the bidirectional female connectors 12 of three lower small M-M rods 350 located on main frame section (2260) and the addition of two pulleys 150 to the M-F outside rods 280 located on main frame section (2260) to generate a fourth main frame section (2280). Step 5 shows the combination of wheels 120 with pulleys 150, mating of two pulleys 150 with the outside portion of wheels 120, mating two pulleys with expandable rod 290, and the mating of four additional wheels to the respective pulleys 150 to generate the toy tricycle 2200.

Figure 23:
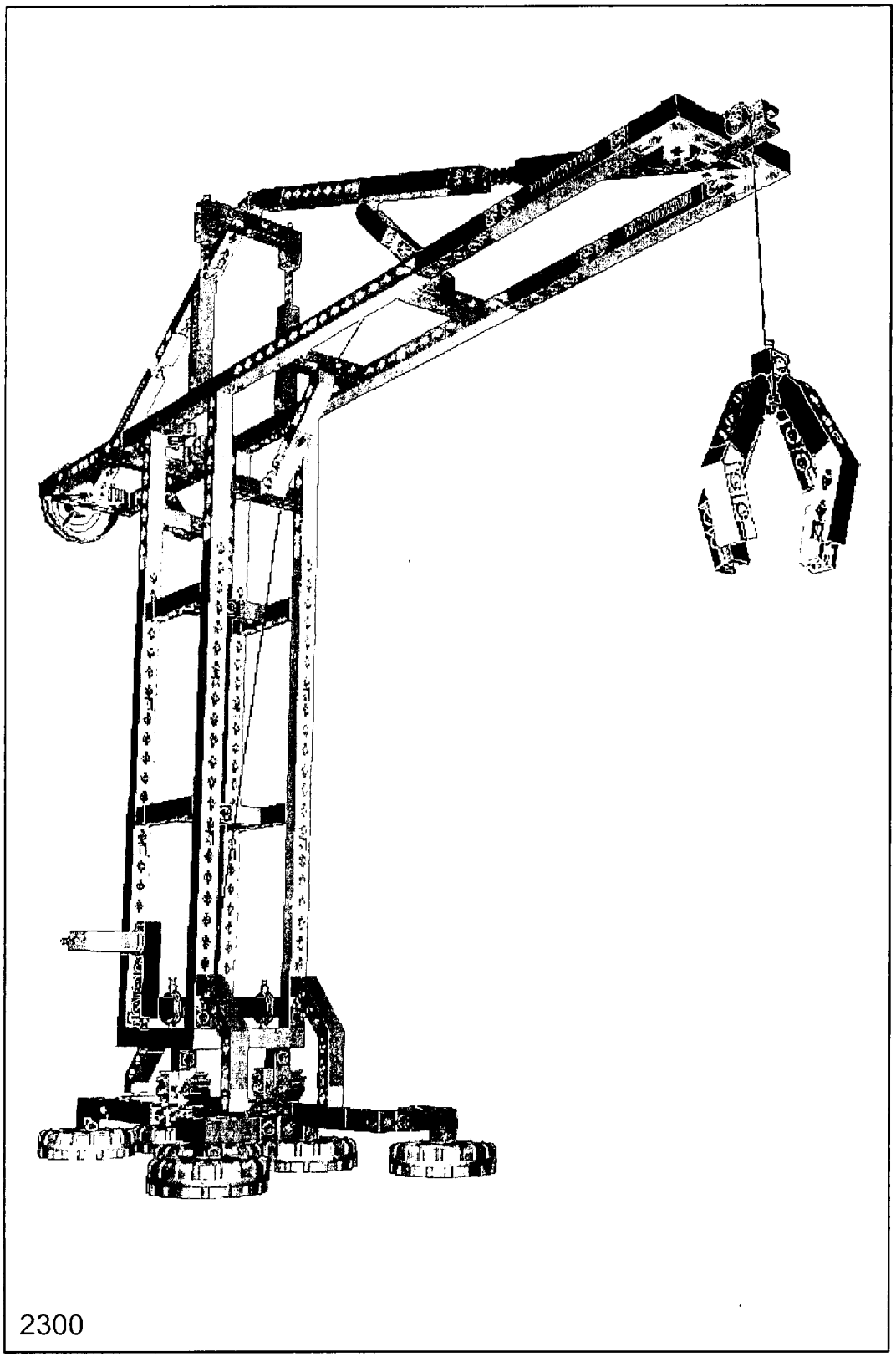
FIG. 23 shows a composite of parts and assembly steps generating a toy crane in accordance with the present invention.

Referring to FIG. 23, toy crane 2300 is shown assembled from components herein described in accordance with the present invention.

Figure 24:
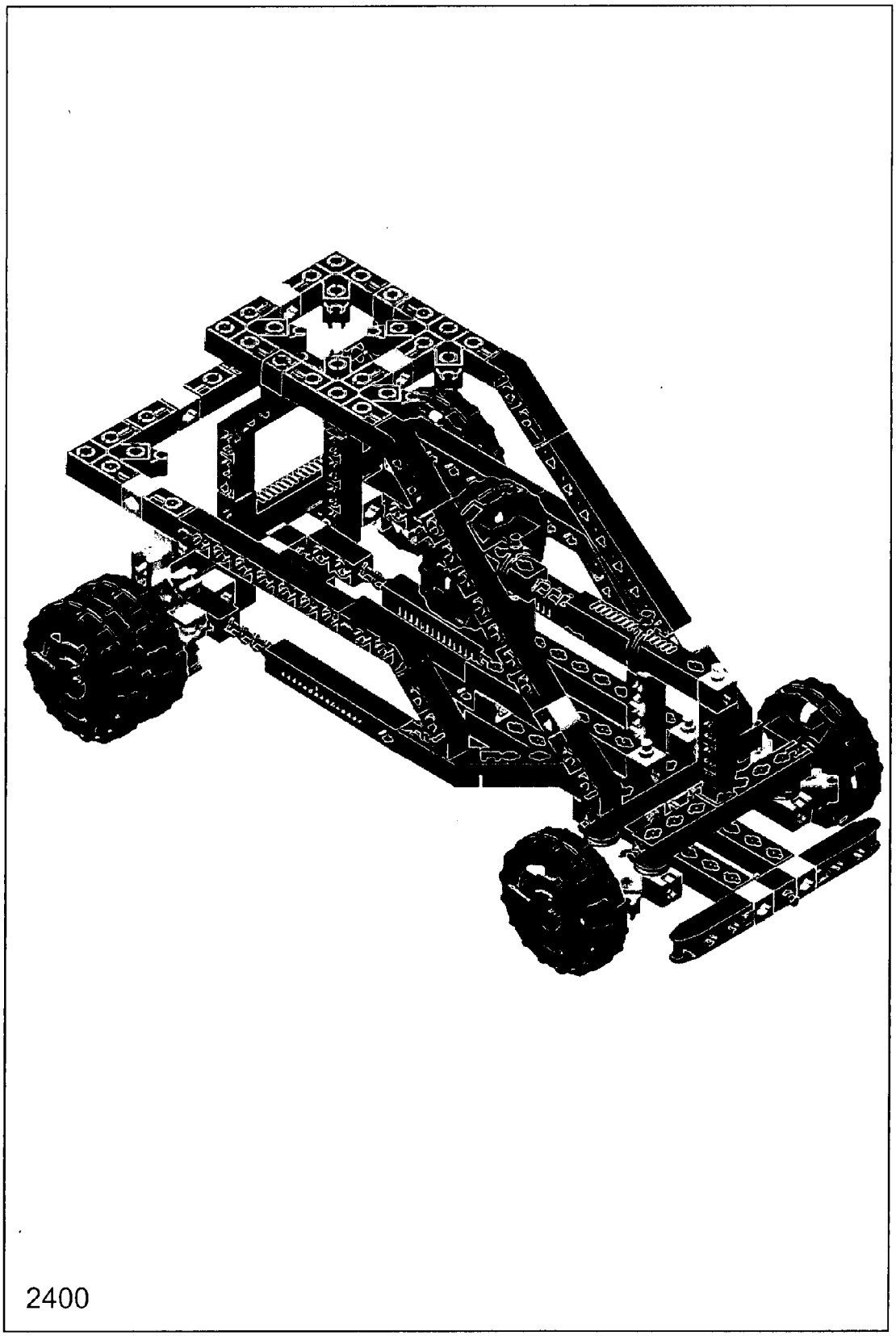
FIG. 24 shows a composite of parts and assembly steps generating a toy all-terrain vehicle in accordance with the present invention.

Referring to FIG. 24, toy all-terrain vehicle 2400 is shown assembled from components herein described in accordance with the present invention.

Figure 25:
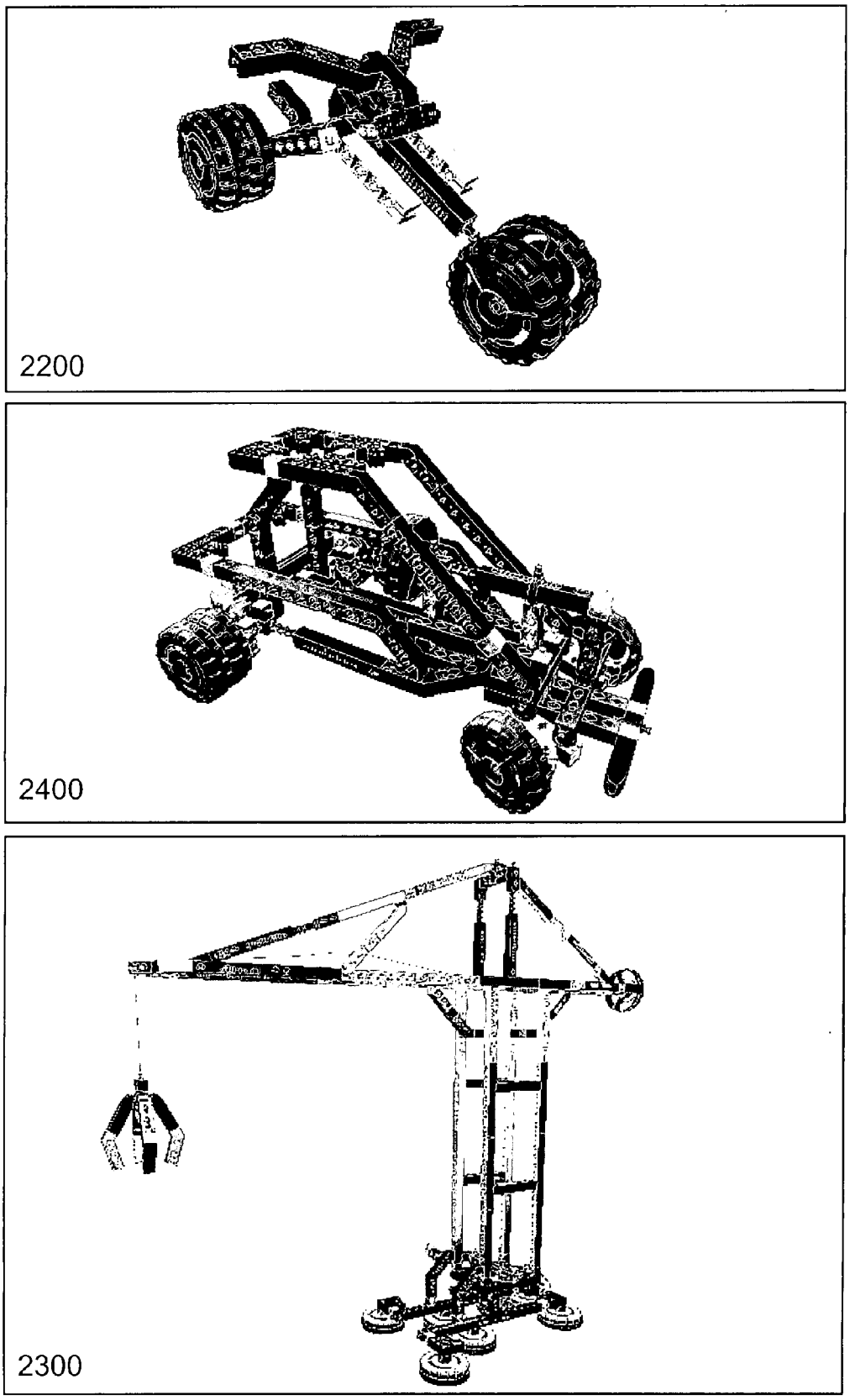
FIG. 25 shows a set of construction toys generated with construction components in accordance with the present invention.

Referring to FIG. 25, various constructable toys are shown assembled from components herein described in accordance with the present invention.

The above description of illustrated embodiments of the invention is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize. By example, it has been shown and mentioned several times that the various male and female connectors may be changed with respect to the example components which have been discussed and described herein. Additionally, various embodiments of the invention may utilize values that are different from what is specified herein. Furthermore, the terms used in the following claims should not be construed to limit the invention to the specific embodiments disclosed in the specification and the claims.

What is claimed is:

1. A construction toy component, wherein the construction toy component includes at least one male connector comprising an external surface with a shoulder, a neck, and a head;

wherein the at least one male connector is inserted coaxially into a first neck region of a female bi-directional snap-lock connector having at least one gap;

wherein the at least one gap allows for expansion until the at least one male connector is fully inserted;

wherein the at least one male connector neck connecting the shoulder and head, said neck having an outer circumference that tapers non-uniformly inward from the shoulder to the head;

wherein the head having a portion that is wider than the adjoining portion of the neck; and wherein each of the at least one male connector shoulder is octagonally shaped.

2. A construction toy component including a female bi-directional snap-lock connector, the female bi-directional snap-lock connector comprising an interrupted non-contiguous inner surface with a first shoulder, a first neck region, and a head region, and at least one gap;

wherein the first neck region of the female bi-directional snap-lock connector being elastically expandable to accommodate slidably non-fixedly connecting with a male connector along the female bi-directional snap-lock connector longitudinal axis and the male connector longitudinal axis;

wherein the construction toy component can be used in a construction toy assembly;

wherein the at least one female bi-directional snap-lock connector includes a first opening and a second opening; and wherein the first opening and the second opening are disposed along a common central axis with no structure therebetween.

3. The construction toy component as in claim 2, wherein the female bi-directional snap-lock connector the first neck region connecting the first shoulder region and the head region, said neck region having an inner circumference that tapers from the first shoulder region to the head region;

the head region having an interrupted non-contiguous inner circumference that increases in size from the first neck region to slidably non-fixedly connect a male connector with the female bi-directional snap-lock connector along the female bi-directional snap-lock connector longitudinal axis; and wherein a portion of a male connector head size diameter is greater than the female bi-directional snap-lock connector interrupted non-contiguous inner circumference of the portion of the female bi-directional snap-lock connector neck region that joins the male connector head region.

4. The construction toy component as in claim 2, wherein the construction toy component comprises at least one u-shaped connector; and wherein the u-shaped connector having ends that curl inward and the ends are elastically expandable apart for insertion of an axle or an approximately cylindrical member.

5. The construction toy component as in claim 2, wherein the construction toy component including two opposed male connectors having a circular or polygonal shape, wherein the two opposed male connectors are connected by an open circular ring, a pivoting component, a gear, a wheel, a tire, a screw thread, a pulley, and a connecting member.

6. The construction toy component as in claim 5, wherein the at least one female bi-directional snap-lock connector being connectable concurrently with two opposing male connectors.

7. The construction toy component as in claim 2, wherein the construction toy component comprises a rod, a male connector connecting to one end and the at least one female bi-directional snap-lock connector.

8. The construction toy component as in claim 7, wherein the construction toy connector comprising an axle.

9. The construction toy component as in claim 8, wherein the construction toy connector is connected to the other end comprising a u-shaped connector.

10. The construction toy component as in claim 6, wherein the construction toy component comprising an elbow, wherein one or more female bi-directional snap-lock connectors formed within the construction toy component; and the construction toy component including a construction toy connector formed within the other end.

11. The construction toy component as in claim 10, the construction toy component including an arm extending at an angle with respect to the construction toy component and including one or more construction toy connectors comprising the male connector, the female connector, the u-shaped connector and the axle.

12. The construction toy component as in claim 2, the construction toy component including multiple arms extending from a central axis, each of said multiple arms including at least one construction toy connector; and wherein the at least one construction toy connector is a male connector or a female bi-directional snap-lock connector or a female uni-directional snap-lock connector or a combination thereof.

13. The construction toy component as in claim 12, wherein the at least one construction toy connector disposed at an angle with respect to at least one other of the construction toy connectors.

14. The construction toy component as in claim 12, wherein the at least one of the construction toy connectors being connectable in two or more directions.

15. A construction toy component comprises at least one male connector, wherein the at least one male connector including a head and a neck sized and proportioned for coaxial insertion, elastic deflection and snap-lock within a female bi-directional snap-lock connector co-axially, the at least one male connector head having a portion with an external circumference that is greater than an abutting portion of the neck wherein the at least one female bi-directional snap-lock connector includes a first opening and a second opening; and wherein the first opening and the second opening are disposed along a common central axis with no structure therebetween;

wherein each of the openings can accept a male connector simultaneously; and wherein the at least one male connector with a male longitudinal axis is configured to slidably non-fixedly connect co-axially with the at least one female bi-directional snap-lock connector along the female bi-directional snap-lock connector longitudinal axis.

16. The construction toy component as in claim 15, the construction toy component including a pulley element, the at least one male connector having a circular polygonal cross section being disposed axially with respect to the pulley element and wherein the pulley element circumferential surface is one or more concave surfaces to retain a line, a belt, a chain, and a rubber band.

17. The construction toy component as in claim 16, the construction toy component including a second male connector disposed opposite the at least one male connector.

18. The construction toy component as in claim 15, the at least one male connector including a shoulder connecting to the neck, the shoulder having a geometrically shaped external surface for reciprocal engagement with the female-connector.

19. The construction toy component as in claim 15, wherein the construction toy connector comprises the at least one male connector, a female connector, an axle, and a u-shaped connector.

20. The construction toy component as in claim 19, the female connector being disposed at an angle non-collinear with respect to the at least one male connector.

21. The construction toy component as in claim 15, the construction toy component including a motor base element, the at least one male-connector being disposed axially with respect to the motor base element.

22. A construction toy assembly including a first and second construction toy component, the first and second construction toy component being non-fixedly slidably connected;

the first construction toy component including a female bi-directional snap-lock connector, the female bi-directional snap-lock connector comprising an elastically expandable neck region and a head region with at least one gap wherein the at least one gap allows expansion;

the second construction toy component including a male connector including a neck and head, the male connector head having a larger outside diameter than the male connector neck, the male connector being sized and proportioned for slidably non-fixedly co-axial insertion within the female bi-directional snap-lock connector longitudinal axis;

the female bi-directional snap-lock connector being elastically expandable to accommodate insertion of the male connector and contraction about a portion of the male connector after insertion;

wherein the at least one female bi-directional snap-lock connector includes a first opening and a second opening; and wherein the first opening and the second opening are disposed along a common central axis with no structure therebetween.

23. The construction toy assembly as in claim 22, the female bi-directional snap-lock connector having a female bi-directional snap-lock connector shoulder region with a geometrically shaped inner surface.

24. The construction toy assembly as in claim 23, the female bi-directional snap-lock connector shoulder region having an octagonally or a three or more sided shaped inner surface.

25. The construction toy assembly as in claim 23, the male connector having a male connector shoulder region with a geometrically shaped outer surface sized and proportioned to mate with the female bi-directional snap-lock connector shoulder region.

26. The construction toy assembly as in claim 23, the male connector having a male shoulder region with a circular shaped outer surface sized and proportioned to rotate within the female bi-directional snap-lock shoulder region.

27. The construction toy assembly as in claim 24, the male connector having a male connector shoulder region with an octagonally or a three or more sided shaped outer surface sized and proportioned to rotate within the female bi-directional snap-lock connector shoulder region.

28. The construction toy assembly as in claim 22, the construction toy assembly including multiple components with corresponding male and bi-directional snap-lock connector female connectors; and the multiple components having varying shapes and sizes;

the multiple components connecting to form a three-dimensional structure.

29. The construction toy assembly as in claim 28, the multiple components including a set of wheels and at least one pulley;

wherein the set of wheels and the at least one pulley have a circular opening to allow rotation; and the multiple components connecting to form a three-dimensional toy crane structure.

* * * * *